United States Patent [19]

Iwase

[11] Patent Number: 4,957,552

[45] Date of Patent: Sep. 18, 1990

[54] ELECTRONIC MUSICAL INSTRUMENT WITH PLURAL MUSICAL TONES DESIGNATED BY MANIPULATORS

[76] Inventor: Hiroyuki Iwase, c/o Yamaha Corporation, 10-1, Nakazawa-cho, Hamamatsu-shi, Shizuoka-ken, Japan

[21] Appl. No.: 253,964

[22] Filed: Oct. 5, 1988

[30] Foreign Application Priority Data

Oct. 7, 1987 [JP] Japan ..... 62-253133

[51] Int. Cl.[5] ..... G10H 7/00; G10H 1/06; G10H 1/18

[52] U.S. Cl. ..... 84/622; 84/602; 84/615; 84/626; 84/631

[58] Field of Search ..... 84/1.01, 1.19, 1.27, 84/1.28, DIG. 12, DIG. 2, 1.24, 1.17, 601–602, 608–611, 613, 622–624, 626, 631, 633

[56] References Cited

U.S. PATENT DOCUMENTS 4,114,497 9/1978 Hiyoshi et al. ..... 84/1.17
4,365,532 12/1982 Nakada et al. ..... 84/1.17 X
4,450,745 5/1984 Nakada et al. ..... 84/1.19
4,586,417 5/1986 Kato et al. ..... 84/1.17
4,706,538 11/1987 Yoshida ..... 84/DIG. 2
4,773,294 9/1988 Iizuka et al. ..... 84/622
4,788,896 12/1988 Uchiyama et al. ..... 84/1.01
4,791,847 12/1988 Nishimoto ..... 84/1.28 X

*Primary Examiner*—A. T. Grimley
*Assistant Examiner*—Matthew S. Smith

[57] ABSTRACT

An electronic musical instrument is provided with plural control switches; a musical tone generating circuit having plural musical tone generating channels generating musical tones in accordance with the operation of the plural control switches; a circuit for indicating the number of tones indicating the number of tones generated by the operation of the manipulators; and an assignment control circuit assigning the operated manipulator to the musical tone generating channels equal in number to the number of tones designated by the circuit for indicating the number of tones and controlling the generation of the musical tones relative to the operated manipulators. Thus, the number of tones generated from the musical tone generating circuit in response to the operation of the manipulators can arbitrarily be set for each manipulator or for each manipulator group, with enjoyment of various performances of the musical instrument.

16 Claims, 15 Drawing Sheets

53f
DATA AREA
FOR CONTROLLING
AUTO-RHYTHM
AND OTHERS 53d
0 CH
1 CH
2 CH
3 CH
15 CH
VOICE
VOICE
VOICE
VOICE
VOICE
PRIOR
PRIOR
PRIOR
PRIOR
PRIOR

53e
MANY
0/1
0/1
CHNO
CHNO 53c
53c1
53c2
53c3
53c4
53c5
53c6
VOICE
POLY
SIMUL
DELAY
PITCH
LEVEL
PAN
ATTACK
DECAY
BEND
MODFRQ
VIBDEP
TREDEP
Δ PITCH 1
Δ LEVEL 1
Δ PAN 1
Δ PITCH 2
Δ LEVEL 2
Δ PAN 2
Δ PITCH 3
Δ LEVEL 3
Δ PAN 3
SUBTON
TIME
ASCH

53a
PLYMD
TKMD
EFMD

53b
INNO 1
INNO 2
DISVO
DISPAR
PARVAL

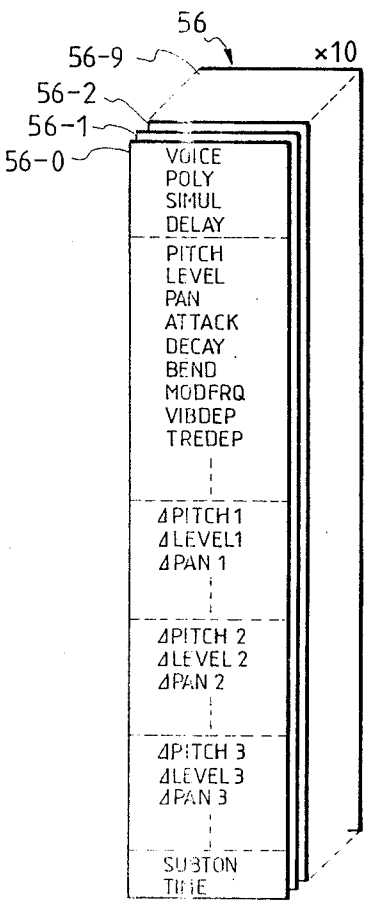
FIG. 5A
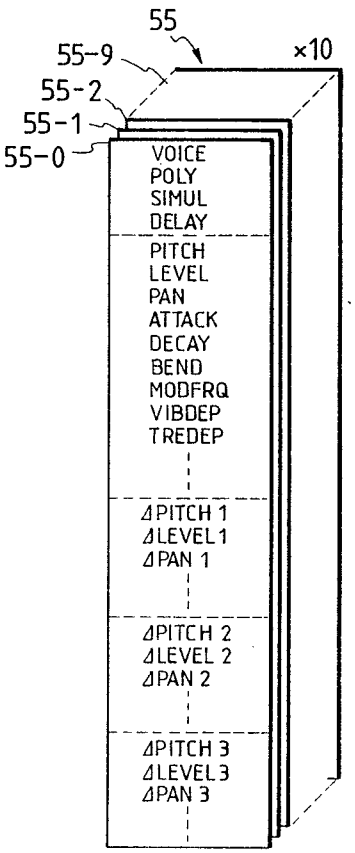
FIG. 5B
FIG. 5C

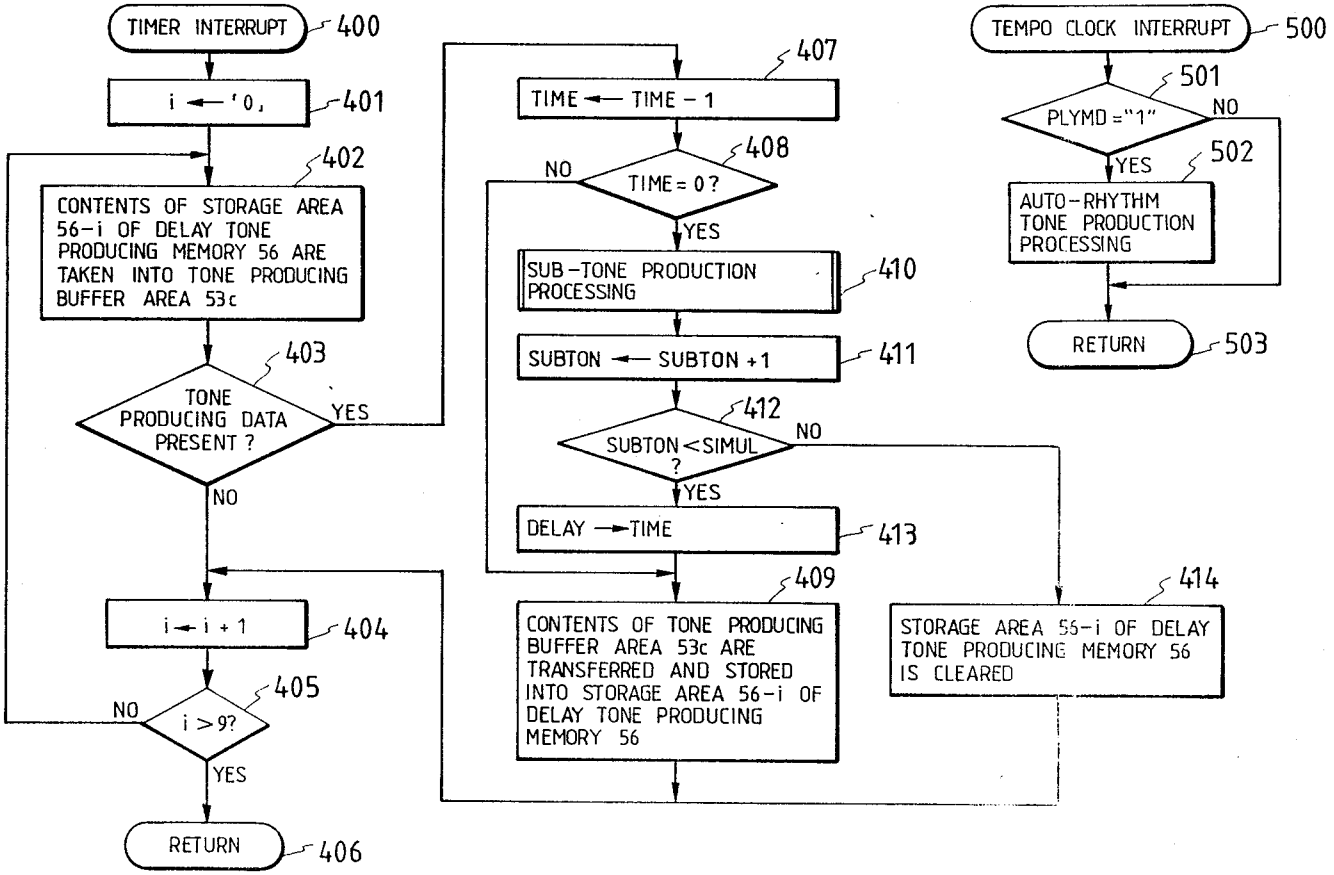
FIG. 19
TEMPO CLOCK INTERRUPT
500
PLYMD = "1"
501
NO
YES
502
AUTO-RHYTHM TONE PRODUCTION PROCESSING
RETURN
503
FIG. 18
TIMER INTERRUPT
400
i ← '0,
401
CONTENTS OF STORAGE AREA 56-i OF DELAY TONE PRODUCING MEMORY 56 ARE TAKEN INTO TONE PRODUCING BUFFER AREA 53c
402
TONE PRODUCING DATA PRESENT ?
403
YES
NO
i ← i + 1
404
i > 9?
405
NO
YES
RETURN
406
TIME ← TIME − 1
407
TIME = 0 ?
408
NO
YES
SUB-TONE PRODUCTION PROCESSING
410
SUBTON ← SUBTON + 1
411
SUBTON < SIMUL ?
412
NO
YES
DELAY ← TIME
413
CONTENTS OF TONE PRODUCING BUFFER AREA 53c ARE TRANSFERRED AND STORED INTO STORAGE AREA 56-i OF DELAY TONE PRODUCING MEMORY 56
409
STORAGE AREA 56-i OF DELAY TONE PRODUCING MEMORY 56 IS CLEARED
414

ELECTRONIC MUSICAL INSTRUMENT WITH PLURAL MUSICAL TONES DESIGNATED BY MANIPULATORS

BACKGROUND OF THE INVENTION (a) Field of the invention

The present invention relates to an electronic musical instrument provided with plural manipulators assigning the generation of musical tones and a musical tone generating device composed of plural musical tone generating channels generating musical tones in accordance with the operation of the plural manipulators.

(b) Description of the Prior Art

In the past, the instrument of this type has been provided with an assignment control device assigning manipulators operated in response to the operation of any of plural manipulators to either one or plural musical tone generating channels equivalent to a predetermined number so that musical tones relative to the operated manipulators are generated in the assigned musical tone generating channels.

In the conventional instrument described above, however, the number of musical tone generating channels assigned by the assignment control device is limited and, when the manipulators are operated, only one kind of musical tone or two kinds of musical tones are always generated and the generation of an arbitrary musical tone cannot be controlled, with the result that an operator has been unable to enjoy performing freely the musical instrument.

Summary of the invention

It is, therefore, the object of the present invention to provide an electronic musical instrument in which the number of musical tones generated for each manipulator or for each group of plural manipulators divided into plural groups can arbitrarily be set so that an operator can enjoy a free performance of the musical instrument.

In order to achieve this object, the electronic musical instrument according to the present invention is provided with, as shown in FIG. 1A, plural manipulators 1 assigning the generation of musical tones, a musical tone generating device 2 composed of plural musical tone generating channels generating the musical tones in accordance with the operation of the plural manipulators, a device for designating the number of tones 3 representing the number of tones capable of being changed for each manipulator or for each group of plural manipulators divided into plural groups and generated by the operation of each of the manipulators 1, and an assignment control device 4 assigning the manipulators 1 operated in response to the operation of any of the plural manipulators 1 to musical tone generating channels equivalent in number to the number of musical tones designated by the device for designating the number of tones 3 and controlling the generation of the musical tones relative to the operated manipulators 1 in the assigned musical tone generating channels. Therefore, in the electronic musical instrument, when the manipulators 1 are operated, the assignment control device 4 assigns the operated manipulators 1 to musical tone generating channels equivalent to the number of musical tones designated by the device for representing the number of tones 3 and controls the generation of the musical tones relative to the operated manipulators 1 in the assigned musical tone generating channels, and the musical tone generating device 2 generates the musical tones relative to the manipulators 1 operated in the assigned musical tone generating channels. In such a case, the number of musical tones designated by the device for representing the number of tones 3 can be changed for each manipulator or for each group of the manipulators, so that an arbitrarily set number of musical tones is generated, with relation to the operated manipulators and in accordance with the operated manipulators, from the musical tone generating device 2. Thus, the number of musical tones generated from the musical tone generating device in accordance with the operation of the manipulators can arbitrarily be set for each manipulator or for each group of the manipulators and an operator can enjoy performing freely the musical instrument.

The electronic musical instrument according to the present invention, as depicted in FIG. 1B, may further be provided with a parameter storing device 5 storing musical tone control parameters controlling a generation mode of each musical tone corresponding to each of the plural manipulators and a parameter changing device 6 changing a plurality of musical tone control parameters stored in the parameter storing device 5. In this instance, when the manipulators 1 are operated, the assignment control device 4 assigns the operated manipulators to musical tone generating channels equivalent to the number of tones designated by the device for representing the number of tones 3 and supplies the musical tone control parameters corresponding to the operated manipulators to the assigned musical tone generating channels to control the generation of the musical tones, and the musical tone generating device 2 generates the musical tones relative to the operated manipulators 1 in the assigned musical tone generating channels and according to the supplied musical tone control parameters. In such a case, since the number of musical tones designated by the device for representing the number of tones 3 can be changed for each manipulator or for each group of the manipulators and the musical tone control parameter can also be changed by the parameter changing device 6, the musical tones whose number is arbitrarily set in accordance with the operated manipulators 1 and whose characteristics are arbitrarily set are generated from the musical tone generating device 2. Thus, the characteristics of a preset number of musical tones generated from the musical tone generating device 2 in response to the operation of the manipulators are properly changed on the basis of the musical control parameters changed by the parameter changing device 6 and, as a result, an operator can enjoy various performances of the musical instrument.

This and other objects as well as the features and the advantages of the present invention will become apparent from the following detailed description of the preferred embodiment when taken in conjunction with the accompanying drawings.

Brief Description of the Drawings

FIG. 5A is a view of memory maps showing details of a parameter memory of FIG. 2;

FIG. 5B is a view of memory maps showing details of a memory corresponding to a pad switch of FIG. 2;

FIG. 5C is a view of memory maps showing details of a delay tone producing memory of FIG. 2; and FIGS. 6 to 19 are flow charts corresponding to examples of programs stored in a program memory of FIG. 2.

Description of the Preferred Embodiment

Figure 1B:
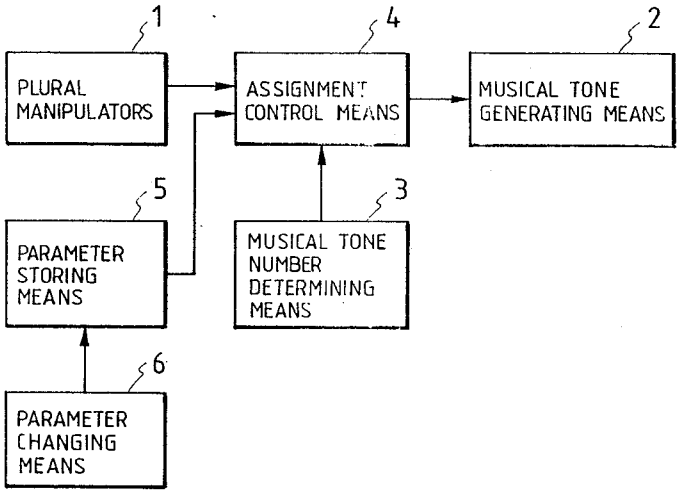
FIG. 1B is a block diagram, similar to FIG. 1A, provided with additional devices.
Figure 1A:
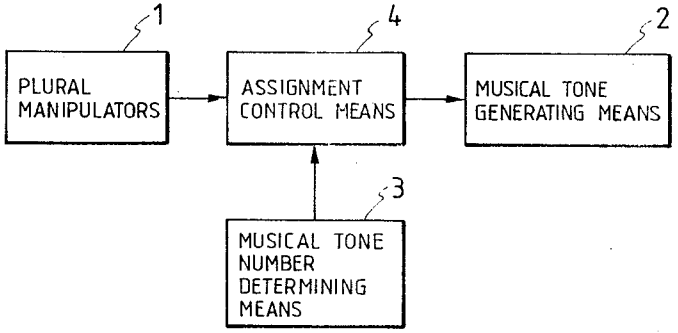
FIG. 1A is a block diagram showing a basic formation of an electronic musical instrument according to the present invention.
Figure 2:
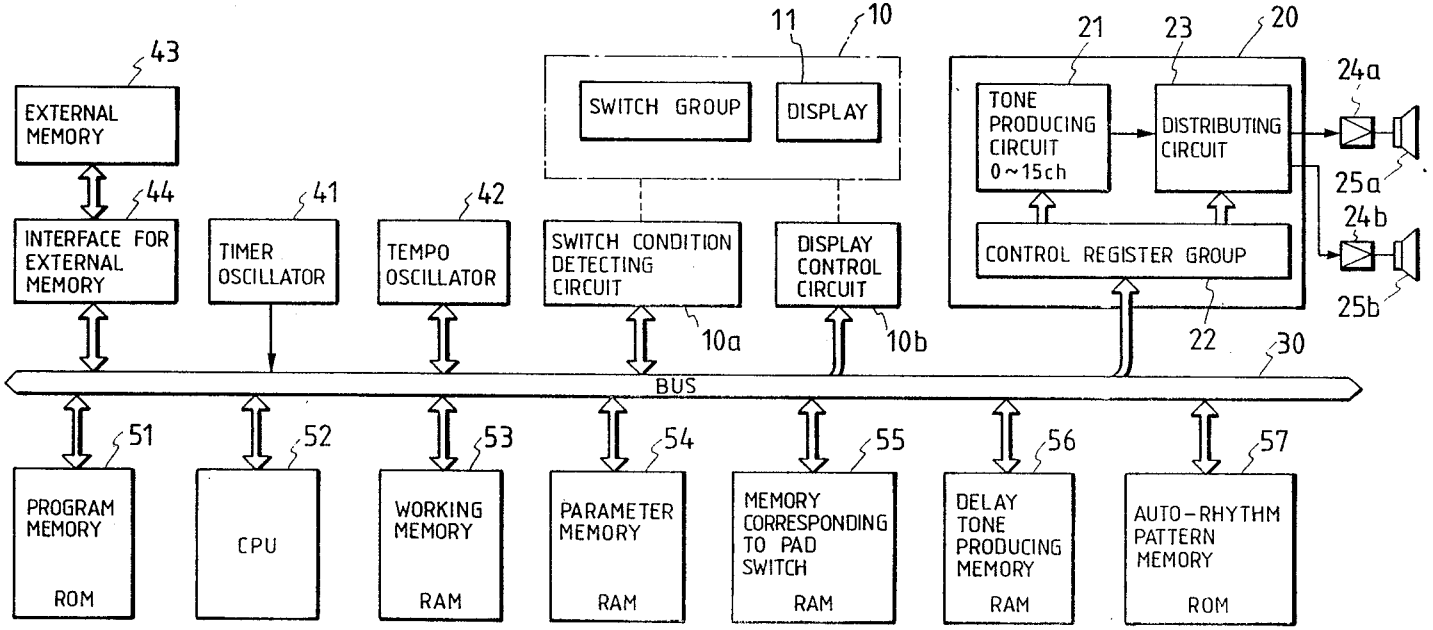
FIG. 2 is a general block diagram showing an embodiment of the electronic musical instrument according to the present invention.

Referring now to the drawings, an embodiment of the present invention will be described below. FIG. 2 shows an example that the present invention is applied to an electronic musical instrument producing tones of percussion instruments such as cymbals, bass drums and the like. The electronic musical instrument is provided with a control panel 10 operated by a performer and a tone generator 20 generating a percussion tone signal in accordance with the operation of the control panel 10 and is designed so that the use of a microcomputor technique makes it possible to control the generation of the tone signal and various types of components are connected to a bus 30.

Figure 3B:
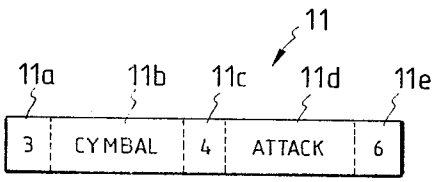
FIG. 3B is a state view showing an example of display states of a display section illustrated in FIG. 3A.
Figure 3A:
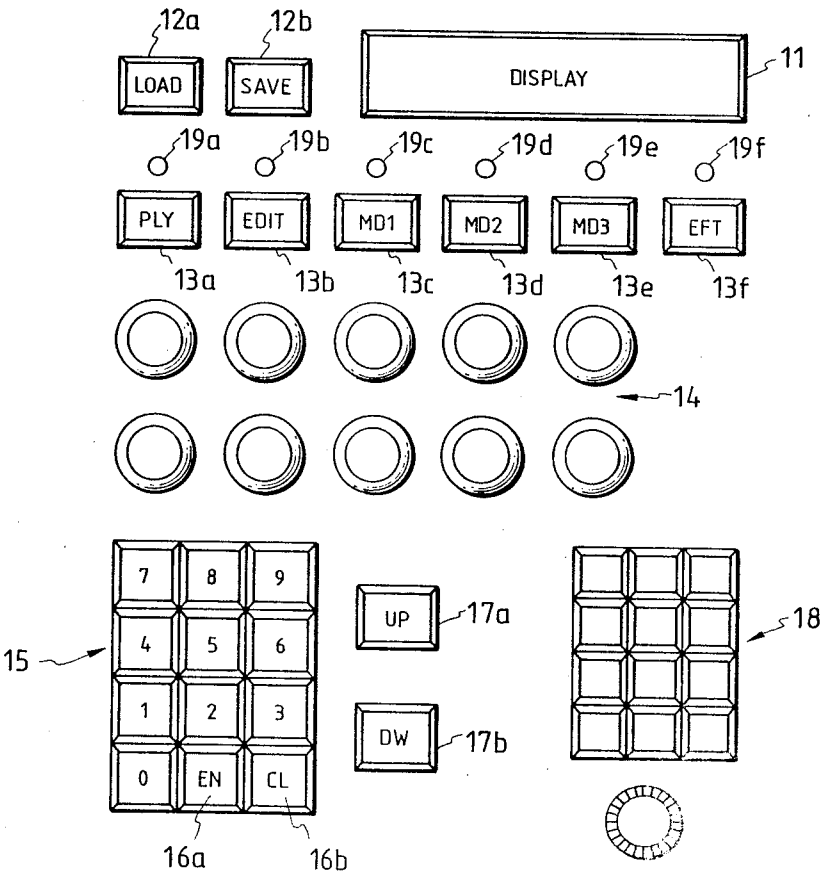
FIG. 3A is a plan view showing details of a control panel illustrated in FIG. 2.
Figures 4A, 4B, 4C, 4D, 4E, 4F:
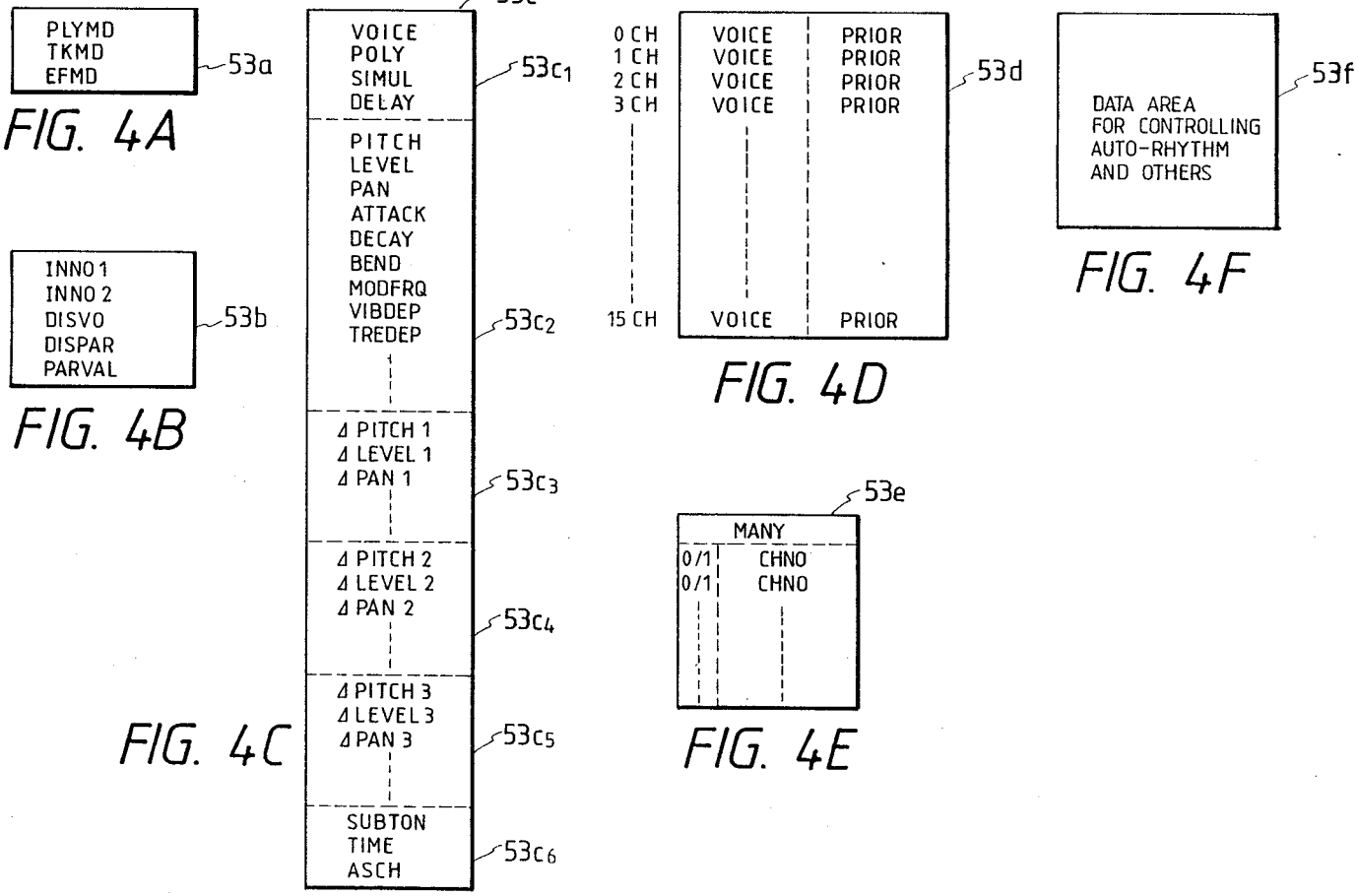
FIGS. 4A to 4F are views of memory maps showing details of a working memory of FIG. 2.

The control panel 10, as shown in FIG. 3A, is provided with the following various control switches and a display section 11.

Input switch 12*a*

The input of data is instructed from an external memory 43 to a parameter memory 54 which will be described later.

Storing switch 12*b*

The storing of data is instructed from the parameter memory 54 to the external memory 43.

Play mode switch 13*a*

The change to a play mode of the electronic musical instrument is instructed.

Edit mode switch 13*b*

The change to an edit mode of the electronic musical instrument is instructed.

First mode switch for ten-key 13*c*

The change to a first available mode of a ten-key switch group 15 described later is instructed.

Second mode switch for ten-key 13*d*

The change to a second available mode of a ten-key switch group 15 described later is instructed.

Third mode switch for ten-key 13*e*

The change to a third available mode of a ten-key switch group 15 described later is instructed.

Effective mode switch 13*f*

Instructions are carried out as to whether or not the effect is brought about.

Pad switch group 14

The generation of a correponding percussion tone is instructed.

Ten-key switch group 15

The quantity is assigned corresponding to "0"–"9".

Enter switch 16*a*

The quantity inputted by the ten-key switch group 15 is secured.

Clear switch 16*b*

The data assigned by the ten-key switch group 15 is cleared.

Up switch 17*a*

The raise of data values is instructed.

Down switch 17*b*

The lowering of data values is instructed.

Auto-rhythm switch group 18

This comprises a plurality of switches assigning the start/stop of the auto-rhythm performance, rhythm types and tempo necessary for the auto-rhythm performance, etc.

The display section 11 is to display numerals and characters and, as depicted in FIG. 3B, is divided into first to fifth display areas 11*a*–11*e* to display a percussion instrument number, percussion instrument name, and a parameter number, parameter name and parameter value for the control of the musical tone, respectively. Further, on the control panel 10, corresponding to the play mode switch 13*a*, editing mode switch 13*b*, first to third mode switches 13*c*, 13*d*, 13*e* for the ten-key switch, and effective mode switch 13*f*, are provided a play mode lamp 19*a*, editing mode lamp 19*b*, first to third mode lamps 19*c*, 19*d*, 19*e* for the ten-key switch, and effective mode lamp 19*f* for indicating individual mode states set by the mode switches 13*a*–13*f*.

The arrangement is such that the conditions of these various control switches are detected by a switch condition detecting circuit 10*a*, which supplies a switch condition signal to the bus 30. The display section 11 and the various lamps 19*a*–19*f* are connected to a display control circuit 10*b*, which controls the display section 11 and the lamps 19*a*–19*f* in accordance with data fed from the bus 30.

The tone generator 20 has a tone producing circuit 21, a control register group 22, and a distributing circuit 23. The tone producing circuit 21 consists of 16 tone producing channels, each of which produces a tone signal for output to the distributing circuit 22 through modes such as read-out and calculation in accordance with tone control data derived from the control register group 22. Also, fundamental tone control parameters necessary for the production of musical tones such as a waveform memory read-out mode and calculation mode are placed in the tone producing circuit 21 for each type of musical instruments whose tones can be produced by the electronic musical instrument. The control register group 22 stores the tone control data fed from the bus 30 to supply them to individual tone producing channels. The distributing circuit 23 distributes the tone signal derived from the tone producing circuit 21 to two channels for output in accordance with the tone control data from the control register group 22. To the distributing circuit 23, loudspeakers 25*a*, 25*b* are connected through amplifiers 24*a*, 24*b*, respectively.

To the bus 30 are further connected a timer oscillator 41, a tempo oscillator 42, and an external memory 43. The timer oscillator 41 should be so as to oscillate with a constant frequency and outputs a timer interrupt signal to the bus 30 every several to several tens milliseconds, for example. The tempo oscillator 42 is adapted to oscillate with a frequency according to tempo control data supplied from the bus 30 and outputs a tempo clock signal of the period corresponding to the frequency to the bus 30. Further, the external memory 43 comprises a magnetic tape, magnetic card, magnetic disc, optical disc, and the like to store various data for save. To the external memory 43 is connected an interface 44 for the external memory, which controls the input/output of data between the external memory 43 and the bus 30.

In addition, a program memory 51, a central processing unit 52 (which will be hereinafter referred to as the CPU 52 simply), and a working memory 53 constituting a principal portion of the microcomputer are connected to the bus 30.

The program memory 51 is constructed from an ROM and stores the programs corresponding to the flow charts depicted in FIGS. 6 to 19. The CPU 52 commences executing a "main program" corresponding to the flow chart of FIG. 6 through the turn-on of a power source switch (not shown) to continue the execution of the program and, by the supply of the timer interrupt signal from the timer oscillator 41 and of the tempo clock signal from the tempo oscillator 42, ceases carrying out the "main program" to execute a "timer interrupt program" and a "tempo clock interrupt program" corresponding to the flow charts of FIGS. 18 and 19, respectively. The working memory 53 is formed from an RAM to store temporarily the data necessary for the execution of the programs relative to the CPU 52 and, as shown in FIGS. 4A to 4F, is separated into a mode control data area **53*a*, an edit data area 53*b*, a tone producing buffer area 53*c*, an assignment table area 53*d*, a same tone assignment table area 53*e*, and a data area for controlling auto-rhythm and others 53*f***.

The mode control data area **53*a*** is such as to store the following data:

Play mode data PLYMD

This is representative of the mode of the electronic musical instrument, in which the play mode is indicated by "1" and the edit mode by "0".

Ten-key mode data TKMD

This represents the utility mode of the ten-key switch group 15, in which the first available mode of the switch group 15 (assignment of storage area numbers 0–99 within a parameter memory 54) is indicated by "0", the second available mode of the switch group 15 (assignment of storage area numbers 0–9 within a memory corresponding to the pad switch 55) by "1", and the third available mode of the switch group 15 (assignment of parameter numbers within the tone producing buffer area **53*c***)

Effective mode data EFMD

This represents whether the effect (for performing the generation of a sub-tone) is brought about, in which effectiveness is indicated by "1" and ineffectiveness by "0".

The edit mode data **53*b*** is such as to store the following data:

First input number data INNO1

The storage area number within the parameter memory 54 or the memory corresponding to the pad switch 55 is indicated.

Second input number data INNO2

The parameter number within the tone producing buffer area **53*c*** is designated.

Display musical instrument number data DISVO

This represents whether the musical instrument name is displayed by a highest-order bit MSB in the display section 11 (a display state is indicated by "1" and non-display state by "0") and stands for the number corresponding to the musical instrument name displayed by a lowest-order bit in the display section 11.

Display parameter number data DISPAR

This represents whether the parameter name is displayed by the highest-order bit MSB in the display section 11 (a display state is indicated by "1" and non-display state by "0") and stands for the number corresponding to the parameter name displayed by the lowest-order bit in the display section 11.

Parameter value data PARVAL

This represents whether the parameter value is displayed by the highest-order bit MSB in the display section 11 (a display state is indicated by "1" and non-display state by "0") and stands for the parameter value displayed by the lowest-order bit in the display section 11.

The tone producing buffer area **53*c* is adapted to store various data relative to a musical instrument that tones are produced by the operation of the pad switch group 14** and is divided into first to sixth areas $53c_1$–$53c_6$.

The first area $53c_1$ is adapted to store control parameters concerning a general matter of a musical instrument tone and is such as to store the following control parameters:

Musical instrument number data VOICE

This is representative of the number corresponding to the name of a musical instrument to be performed.

Available channel quantity data POLY

This indicates how many channels are available for the performance of the musical instrument corresponding to the musical instrument number data VOICE.

Producing tone number data SIMUL

This indicates how many musical instrument tones are producing at that moment, corresponding to the musical instrument number data VOICE through a single operation of the pad switch group 14. Also, in this embodiment, a setable number of sounding tones is limited to "4" at the maximum, which comprises one main tone and three pieces of first, second and third sub-tones. The relationship between the producing tone number and the tone to be produced is shown in a table as follows:

| Producing tone number | Tone to be produced |
|---|---|
| 1 | main tone |
| 2 | main tone; first sub-tone |
| 3 | main tone; first and second sub-tones |
| 4 | main tone; first, second and third tones |

Delay data DELAY

This represents time intervals between the musical instrument tones produced in the case of more than one type of the producing tone number data SIMUL.

The second area $53c_2$ is adapted to store musical tone control parameters relative to the main tones of individual musical instruments and is such as to store the parameters of pitch data PITCH (controlling the pitch of the musical tone), level data LEVEL (controlling the loudness of the tone), pan data PAN (the tone image position of the tone), attack data ATTACK (controlling the rising time of the tone), decay data DECAY (controlling the decay time of the tone), bend data BEND (controlling the frequency deflection of the rising time of the tone and the restoring time from a deflected state to a normal state), modifying frequency data MODFRQ (controlling the frequency of a modifying signal modifying the tone), vibrato depth data VIBDEP (controlling the depth of vibrato in a vibrato effect), tremolo depth data TREDEP (controlling the depth of tremolo in a tremolo effect), and the like.

The third to fifth areas $53c_3$–$53c_5$ is adapted to store musical, tone, control parameters relative to first to third sub-tones of musical instruments, respectively and is formed so as to store the parameter, of modifying pitch data ΔPITCH, modifying level data ΔLEVEL, modifying pan data ΔPAN, and the like for modifying the pitch data PITCH, level data LEVEL, pan data PAN, and the like concerning the main tones.

The sixth area $53c_6$ is adapted to store control parameters relating to the tone production control of main tones and sub-tones and is such as to store the following control data:

Sub-tone number data SUBTON

This represents the tone number of sub-tones to be produced.

Time data TIME

This represents a lapse time from the time a main tone or sub-tone is previously sounded to the time a subsequent sub-tone is produced.

Assignment channel number data ASCH

This indicates the musical tone generating channel number of musical tones (main tone and sub-tone) to be assigned.

The assignment table area **53*d* is used to assign the musical tones to the musical tone producing channels of "0"–"15" of the tone producing circuit 21**, and is such as to store the musical instrument number data VOICE already assigned corresponding to the channels and assignment priority order data PRIOR thereof. Also, the assignment priority order data PRIOR changes in the range of "0" to "15" and means that the assignment priority order becomes higher as its number increases.

The same tone assignment table area **53*e* is utilized for finding the tone producing channel to which the same tone (musical instrument tone concerning the same pad switches 14) is assigned, and is formed so as to store same tone number data MANY indicative of the number of assigned same tones and channel number data CHNO indicative of an assignment channel. Also, the highest-order bit MSB of the channel number data CHNO indicates with "1" that the assignment is completed and with "0" that nonassignment is completed. The data area 53*f* is adapted to store the data for auto-rhythm control, the data for detecting the operation of the switch group of the control panel 10**, and the like.

Furthermore, to the bus 30 are connected the parameter memory 54, the memory corresponding to the pad switch 55, a delay tone producing memory 56, and an auto-rhythm pattern memory 57 as the data storages of the microcomputer.

The parameter memory 54 is constructed from an RAM and, as depicted in FIG. 5A, is composed of storage areas 54-0, 54-1, . . . , 54-99 corresponding to a large number of musical instrument tones, for example, 100 types of musical instrument tones, which store various control parameters placed in the first to fifth areas $53c_1$–$53c_5$ of the tone producing buffer area **53*c* for each musical instrument tone. The memory corresponding to the pad switch 55 is formed of an RAM and, as shown in FIG. 5B, is composed of storage areas 55-1, 55-1, . . . , 55-9 corresponding to 10 switches of the pad switch group 14, which store various control parameter, similar to the case of the parameter memory 54, for each of the pad switches 14. The delay tone producing memory 56 is constructed from an RAM and, as shown in FIG. 5C, comprises storage area 56-0, 56-1, . . . , 56-9 corresponding to each switch of the pad switch group 14, which store various control parameters, similar to the case of the parameter memory 54, for each of the pad switches 14 and the sub-tone number data SUBTON and the time data TIME for each of the pad switches 14. The auto-rhythm pattern memory 57 is constructed from an ROM and stores the tone producing pattern data of the percussion instrument tones for each rhythm type. Also, the memory 57** may be formed of an RAM to make it possible for the pattern data to be restored.

Next, referring to the flow charts, the operation of the embodiment constructed as mentioned above will be explained below.

Figure 6:
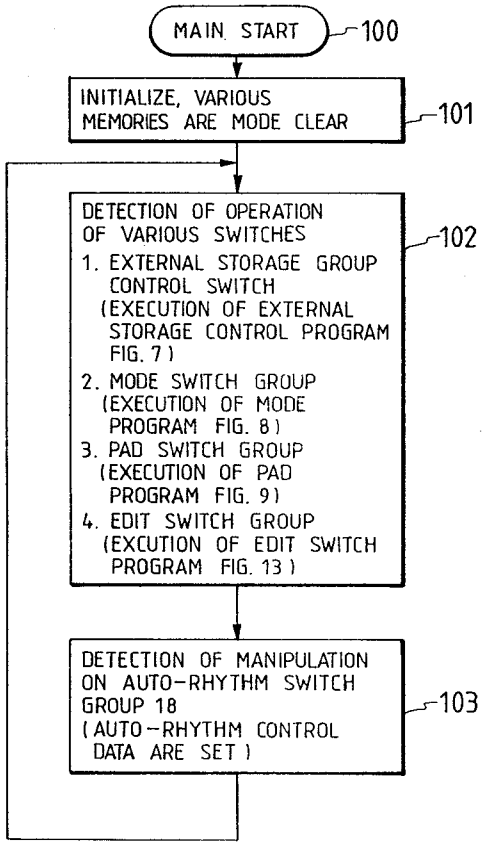

When a power source switch (not shown) is turned on, the CPU 52 initiates the execution of the "main program" in step 100 of FIG. 6 and initializes the electronic musical instrument by clearing the contents of various memories in step 101. After this initialization, the CPU 52 carries out cyclic processing composed of steps 102, 103 to control the generation of the musical tone. In such a case, when the switches other than the auto-rhythm switch group 18 are operated on the control panel 10, various subprograms according to the operation of the switches are executed in step 102 and, when the auto-rhythm switch group 18 is operated, auto-rhythm control data according to the operation are set to the data area **53*f* within the working memory 53 in step 103**.

The operation of the electronic musical instrument will be explained in accordance with its sequence in the following.

Input/output of data with external memory 43

The input/output of data between the external memory 43 and the parameter memory 54 will be explained herein.

Figure 7:
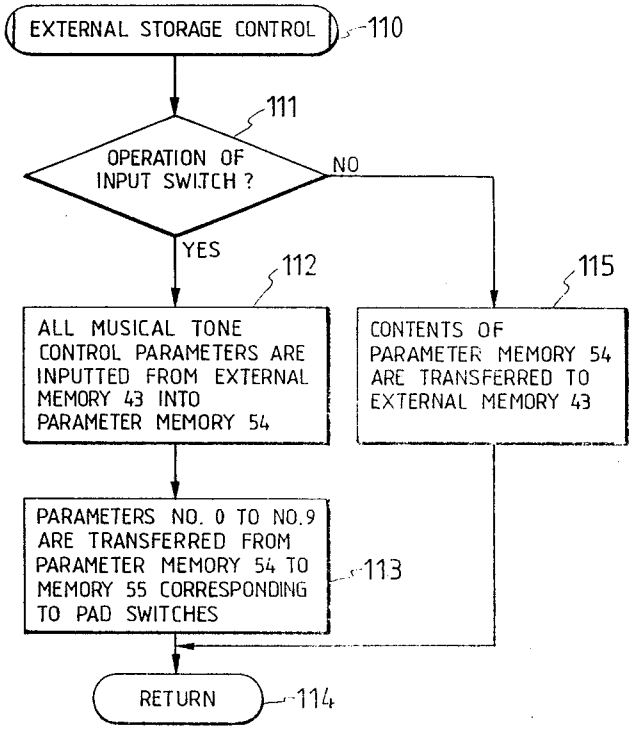

When a player operates the input switch **12*a*, its switch operation is detected in step 102 and a "external memory control program" corresponding to the flow chart of FIG. 7 is executed. In this case, the execution of the "external memory control program" is started in step 110, the result of the judgment in step 111 indicates "YES", namely, that the input switch 12*a* has been operated, and in step 112, the tone control parameters placed in the external memory 43 are stored into individual storage areas 54-0, 54-1, . . . , 54-99 of the parameter memory 54 through the interface for the external memory 44 and the bus 30. Also, these stored tone control parameters are the data previous stored into the external memory 43, which may be the data saved in the parameter memory 54 by the processing described later or may be those previously prepared by others. After the processing of such step 112, the tone control parameters within the 0-th to ninth storage areas 54-0, 54-1, . . . , 54-9 of the parameter memory 54 are transferred to and stored into the storage areas 55-0, 55-1, . . . , 55-9, respectively, of the memory corresponding to the pad switch 55 in step 113 and the execution of the "external memory control program" is completed in step 114. After this completion, the cyclic processing including steps 102, 103 of the "main program" is repeatedly executed. The processing of steps 111–113 allows the storing of the tone control parameters into the parameter memory 54 and the initialization of the tone control parameters of the memory corresponding to the pad memory 55**.

Further, when the player operates the storing switch **12*b*, the "external memory control program" is executed in response to the detection of the switch operation as in the case mentioned above. In such an instance of the "external memory control program", the result of the judgment in step 111 indicates "NO", namely, that the storing switch 12b has been operated, and in step 115, all the tone control parameters placed in the storage areas 54-0, 54-1, . . . , 54-99 of the parameter memory 54 are transferred to and stored into the external memory 43 through the bus 30 and the interface for the external memory 44. Thereby, the tone control parameters placed in the parameter memory 54 are stored into the external memory 43** as the data for save.

Mode setup

Next, the setup of various operation modes of the electronic musical instrument is described.

Figure 8:
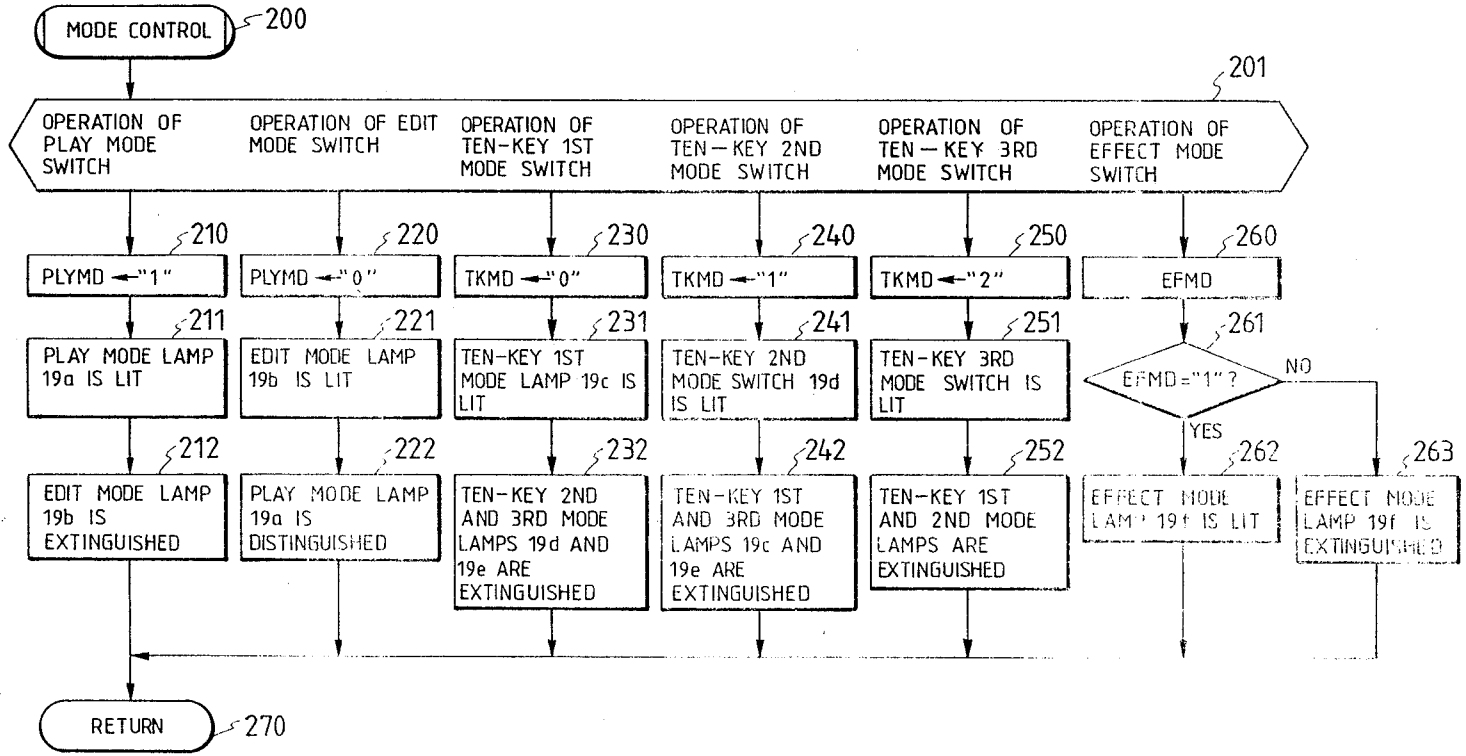

When the player operates any of mode switches comprising the mode switch 13a, edit mode switch 13b, first to third mode switches for the ten-key switch 13c, 13d, 13e, and effective mode switch 13f, the CPU 52 executes a "mode control program" corresponding to the flow chart of FIG. 8 in step 102 during the cyclic processing of the "main program".

Where the play mode switch 13a is operated, the execution of "mode control program" is started in step 200, the result of the judgment of step 201 causes the processing of steps 210–212 to be carried out, and the execution of the "mode control program" is completed in step 270 so that the "main program" is executed again. In such an instance, the play mode data PLYMD is set to "1" in step 210 and the control data for turning on the play mode lamp 19a and turning off the edit mode lamp 19b in steps 211, 212, respectively are outputted to the display control circuit 10b through the bus 30. As a result, the electronic musical instrument is set to the play mode, which is indicated through the turn-on of the play mode lamp 19a.

Also, where the edit mode switch 13b is actuated, the result of the judgment in step 201 causes the processing of steps 220–222 to be executed. In such a case, the play mode data PLYMD is set to "0" in step 220 and the control data for turning on the edit mode lamp 19b and turning off the play mode lamp 19a in steps 221, 222, respectively are outputted to the display control circuit 10b through the bus 30. As a result, the electronic musical instrument is set to the edit mode, which is indicated through the turn-on of the edit mode lamp 19b.

Further, where the first mode switch for ten-key 13c is actuated, the result of the judgment in step 201 causes the processing of steps 230–232 to be executed. In such a case, the ten-key mode data TKMD is set to "0" in step 230 and the control data for turning on the first mode lamp for ten-key 19c and turning off the second and third mode lamps for ten-key 19d, 19c in steps 231, 232, respectively are outputted to the display control circuit 10b through the bus 30. Consequently, the ten-key switch group 15 is set to the first utility mode, which is indicated through the turn-on of the first mode lamp for ten-key 19c.

Also, where the second mode switch for ten-key 13d is operated, the result of the judgment in step 201 causes the processing of steps 240–242 to be executed. In such an instance, the ten-key mode data TKMD is set to "1" in step 240 and the control data for turning on the second mode lamp for ten-key 19d and turning off the first and third mode lamps for ten-key 19c, 19e in steps 241, 242, respectively are outputted to the display control circuit 10b through the bus 30. As a result, the ten-key switch group 15 is set to the second utility mode, which is indicated through the turn-on of the second mode lamp for ten-key 19d.

Furthermore, where the third mode switch for ten-key 13e is operated, the processing of steps 250–252 is performed as the result of the judgment of step 201. In such an instance, the ten-key mode data TKMD is set to "2" in step 250 and the control data for turning on the third mode lamp for ten-key 19e and turning off the first and second mode lamps for ten-key 19c, 19d in steps 251, 252 respectively are outputted to the display control circuit 10b through the bus 30. Consequently, the ten-key switch group 15 is set to the third utility mode, which is indicated through the turn-on of the third mode lamp for ten-key 19e.

In addition, where the effective mode switch 13f is operated, the processing of steps 260–263 is executed as the result of the judgment of step 201. In this case, the effective mode data EFMD is reversed in step 260 and judgment is made in step 261 as to whether or not the reversed effective mode data EFMD is "1". Here, if the reversed effective mode data EFMD is "1", the judgment in step 261 is decided "YES" and, in step 262, the control data for turning on the effective mode lamp 19f is outputted to the display control circuit 10b through the bus 30. On the other hand, if the reversed effective mode data EFMD is "0", the judgment in step 261 is decided "NO" and, in step 263, the control data for turning off the effective mode lamp 19f is outputted to the display control circuit 10b through the bus 30. As a result, the effective mode switch, 13f makes a distinction as to whether the effective mode is brought about, which is indicated by the effective mode lamp 19f.

Play mode

Next, description is made of the play mode generating musical tones in response to the operation of individual switches of the pad switch group 14. In this case, the play mode data PLYMD is previously set to "1" by the execution of the "mode control program".

Figure 9:
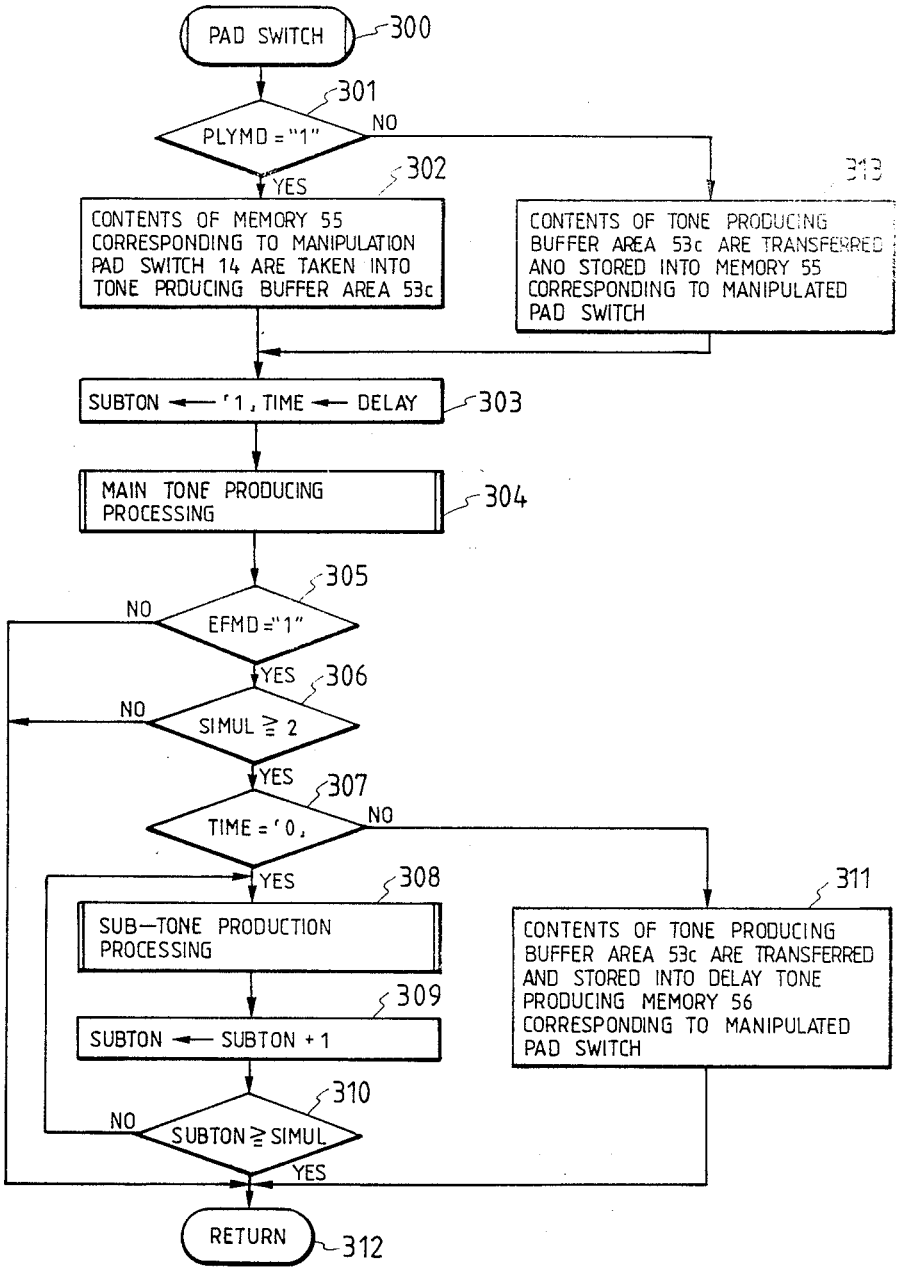

When any switch of the pad switch group 14 is operated, the CPU 52 commences, in step 300, to execute a "pad switch program" corresponding to the flow chart of FIG. 9 in step 102 during the cyclic processing of the "main program" and makes the judgment of "YES" in step 301 on the basis of the play mode data PLYMD set to "1" to advance the program to step 302.

In this step 302, the tone control parameters placed in a storage area (all the tone control parameters of, for example, the storage area 55-3) of the memory corresponding to the pad switch 55 corresponding to the operated switch of the pad switch group 14 are inputted into the first to fifth areas $53c_1$–$53c_5$ of the tone producing buffer area 53c and, in step 303, the sub-tone number data SUBTON within the sixth area $53c_6$ of the buffer area 53c is set to "1" indicating the first sub-tone and the time data TIME is set to the input value of the delay data DELAY.

Figure 10:
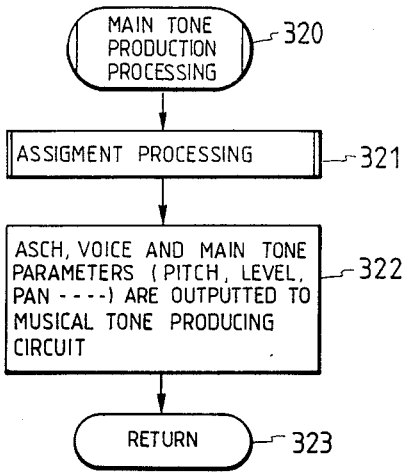
Figure 12:
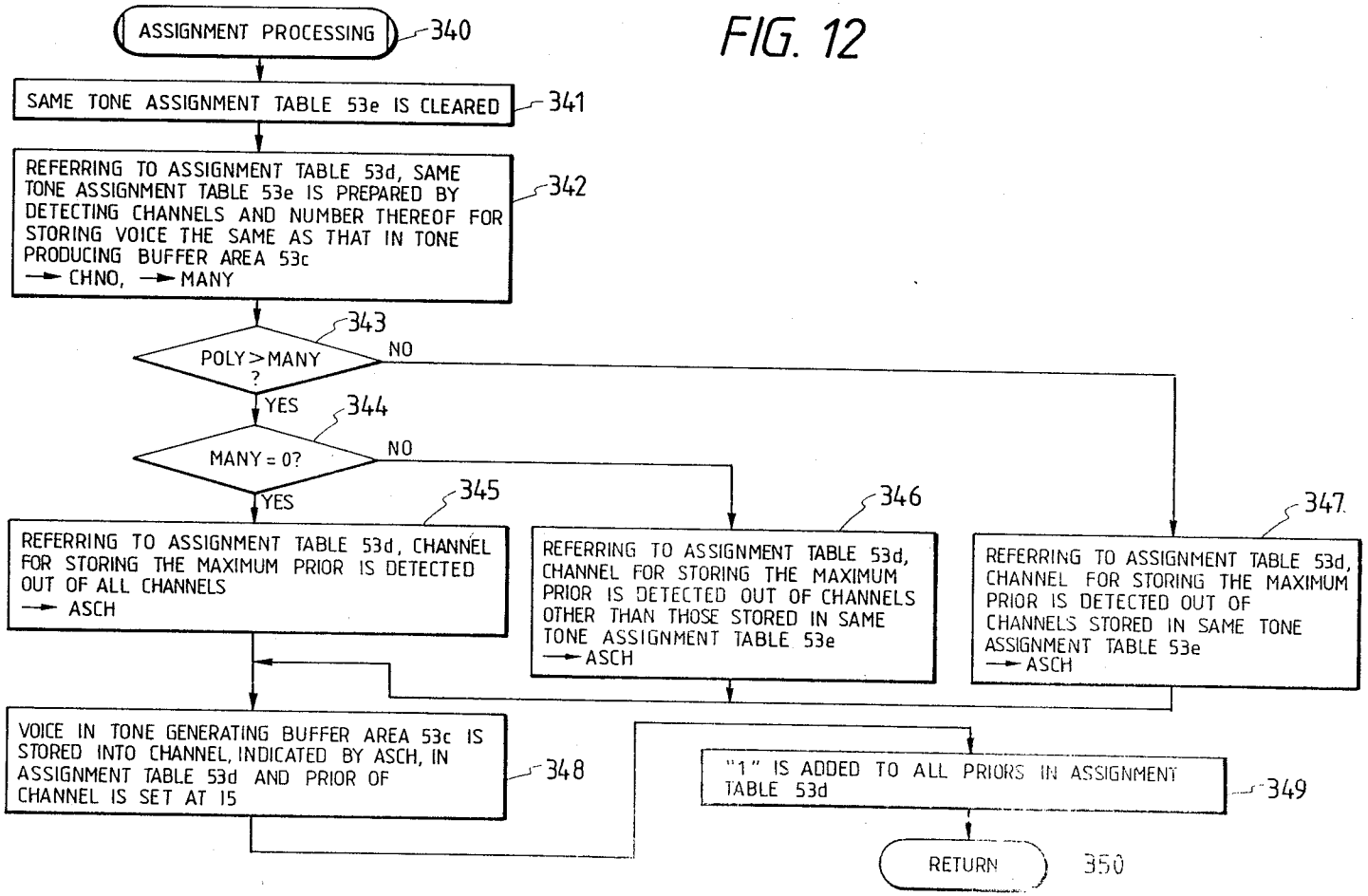

Then, in step 304, a "main tone producing program" corresponding to the flow chart of FIG. 10 is outputted for execution. The "main tone producing program" is started in execution in step 320 and an "assignment processing program" corresponding to the flow chart of FIG. 12 is outputted for execution in step 321.

The "assignment processing program" is started in execution in step 340 and then all the data within the same tone assignment table area 53e are cleared in 341. Next, in step 342, the CPU 52 extracts the musical tone generating channels storing the musical instrument number data VOICE same as that within the tone producing buffer area 53e by referring to the assignment table area 53d and places the channel number data CHNO representative of the extracted channels in the same tone assignment table area 53e and the extracted number as the same tone number data MANY in the area 53e. Also, in this case, the highest-order bit MSB of the channel number data CHNO stored is previously set to "1". Thereby, the musical tone generating channels and their number are detected to which the musical instrument tones to be generated by the operation of the pad switch group 14 have already been assigned. After the processing of step 342, the channels assigning the musical instrument tones to be now generated are searched, through the processing of steps 343–347, based on the following conditions.

(Condition 1)

Where the number of channels to which the musical instrument tones to be generated are already assigned does not reach that available for the generation of the tones, the generation of new musical instrument tones is assigned to channels initiating the earliest generation of the tones (which will be hereinafter referred to as the oldest channels) among the channels other than those to which the tones are already assigned.

(Condition 2)

Where the number of channels to which the musical instrument tones to be generated are already assigned reaches that available for the generation of the tones, the generation of new musical instrument tones is assigned to the oldest channels among the channels to which the tones are already assigned.

In other words, if the value of the same tone number data MANY is smaller than that of the available channel number data POLY, the judgment in step 343 results in "YES" and the processing of steps 344–346 is executed. In this instance, where the musical instrument tones to be newly generated are not yet assigned to any of the tone generating channels, the value of the same tone quantity data MANY is "0" and the judgment in step 344 is "YES", so that the CPU 52 determines, in step 345, a channel storing the assignment priority order data PRIOR of the maximum value from among all the channels, as an assignment channel, by referring to the assignment table area 53d and sets the value representative of the channel as the assignment channel number data ASCH. Contrary, if the tones to be newly generated are already assigned to any of the tone generating channels, the value of the same tone quantity data MANY is not "0" and the judgment in step 344 is "NO", with the result that, in step 345, the CPU 52 determines a channel storing the assignment priority order data PRIOR of the maximum value from among the channels other than the value of the channel number data CHNO placed in the same tone assignment table area 53e, as an assignment channel, by referring to the assignment table area 53d and sets the value representative of the channel as the assignment channel number data ASCH.

On the other hand, if the value of the same tone number data MANY is equal to that of the available channel number data POLY, the judgment in step 343 results in "NO", so that in step 347, the CPU 52 determines a channel storing the assignment priority order data PRIOR of the maximum value from among the same channels as the value of the channel number data CHNO placed in the same tone assignment table area 53e, as an assignment channel, by referring to the assignment table area 53d and sets the value representative of the channel as the assignment channel number data ASCH. After the processing of these steps 345–347, the CPU 52 inputs the musical instrument number data VOICE within the tone producing buffer area 53c into a storage position of the assignment table area 53d corresponding to the value of the assignment channel number data ASCH and simultaneously sets the assignment priority order data PRIOR to "15". Next, "1" is added to all the assignment priority order data PRIOR within the assignment table area 53d in step 349 and the execution of the "assignment processing program" is completed in step 350. Thereby, the assignment channel of the musical instrument tone corresponding to the operated switch of the pad switch group 14 is determined and the register of the musical instrument tone for the assignment table area 53d is completed.

After the completion of the "assignment processing program", the CPU 52 returns to the execution of the "main tone producing processing program" (FIG. 10) and, in step 322, outputs the tone control parameters such as the musical instrument number data VOICE stored in the first area $53c_1$ and the pitch data PITCH, level data LEVEL, pan data PAN, attack data ATTACK, . . . , etc. stored in the second area $53c_2$ of the tone producing buffer area 53c and the assignment channel number data ASCH stored in the sixth area $53c_6$ of the tone producing buffer area 53c to the tone generator 20 through the bus 30 so that, in step 323, the execution of the "main tone producing processing program" is completed.

In the tone generator 20, the control register group 22 fetches and stores individual data in the foregoing and the tone producing channel corresponding to the assignment channel number data ASCH within the tone producing circuit 21 forms a tone signal corresponding to the musical instrument tone assigned by the musical instrument number data to output the signal to the distributing circuit 23. In this case, the formed tone signal is such that tone components such as pitch, loudness, attack time, and the like are controlled by the tone control parameters such as the pitch data PITCH, level data LEVEL, attack data ATTACK, and the like, and is distributed to the amplifiers 24a, 24b for output in accordance with the ratio indicated by the pan data PAN through the distributing circuit 23. The distributed and outputted tone signal is outputted from the loudspeakers 25a 25b as a musical tone. Thereby, the musical tone is produced, from the loudspeakers 25a, 25b, which is of the type corresponding to the operated switch of the pad switch group 14 and in which the tone components such as pitch, loudness, attack time, tone image position, and the like are determined by the tone control parameters for the main tone which are stored in the second area $53c_2$ of the tone producing buffer area 53c.

After the "main tone producing processing program" is completed, the CPU 52 returns to the execution of the "pad switch program" (FIG. 9) and judges whether or not the effective mode data EFMD is "1" and whether or not the producing tone number data SIMUL is "2" or more in steps 305, 306, respectively. Here, if the effective mode data EFMD is "0" or the producing tone number data SIMUL is less than "2", the result of the judgment in step 305 or step 306 indicates "NO" and the execution of the "pad switch program" is completed in step 312. In such an instance, the musical instrument tone corresponding to the operated switch of the pad switch group 14 is produced with respect to only the main tone independently of the sub-tone described later.

Figure 11:
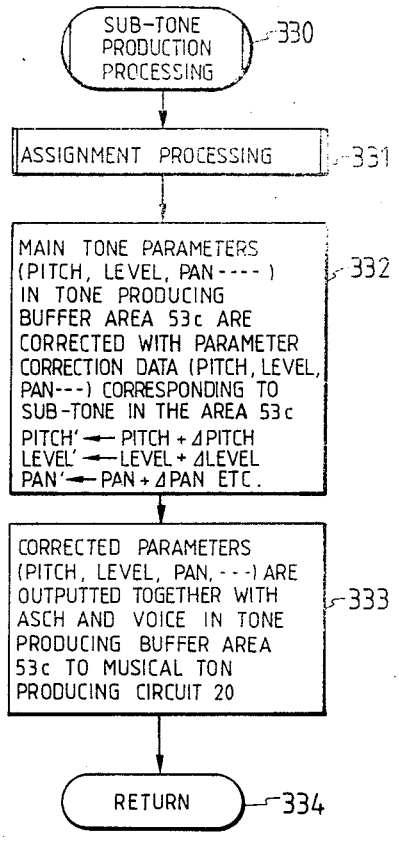

On the other hand, if the effective mode data EFMD is "1" and the producing tone number data SIMUL is "2" or more, the results of the judgment in steps 305, 306 is determined "YES" and, in step 307, judgment is given as to whether the time data TIME set to the value of the delay data DELAY through the processing of step 303 is "0". In such a case, if the time data TIME is "0", the judgment in step 307 is "YES" and a "sub-tone producing processing program" corresponding to the flow chart of FIG. 11 is then executed in step 308. The "sub-tone producing processing program" is such that the execution is initiated in step 330 and the "assignment processing program" (FIG. 12) is outputted and executed in step 331 as in the case of the main tone producing processing program, followed by the processing that the assignment channel of the first sub-tone corresponding to the operated switch of the pad switch group 14 is determined and the register of the sub-tone for the assignment table area **53*d* is carried out. After the processing of this step 331, the CPU 52 outputs the tone parameters for the main tone such as the pitch data PITCH, level data LEVEL, pan data PAN, and the like within the second area $53c_2$ of the tone producing buffer area 53*c* and the tone parameter modifying data for the sub-tone such as the modifying pitch data ΔPITCH1, modifying level data ΔLEVEL1, modifying pan data ΔPAN1, and the like within the third area $53c_3$ of the buffer area 53*c*** and modifies the tone control parameters for the main tone to form the tone control parameters for the first sub-tone, by the execution of calculations such as $$PITCH' = PITCH + \Delta PITCH$$
$$LEVEL' = LEVEL + \Delta LEVEL$$
$$PAN' = PAN + \Delta PAN.$$

Then, in step 333, the modified tone control parameters for the sub-tone are outputted to the tone generator 20 through the bus 30 and, as in the case of the main tone, the musical instrument number data VOICE stored in the first area $53c_1$ of the tone producing buffer area **53*c* and the assignment channel number data ASCH stored in the sixth area $53c_6$ of the tone producing buffer area 53*c* are outputted to the tone generator 20 through the bus 30, with the completion of the execution of the "sub-tone producing processing program" in step 334**.

In the tone generator 20, as in the case of the main tone, the tone producing channel corresponding to the assignment channel number data ASCH within the tone producing circuit 21 forms a tone signal corresponding to the first sub-tone, based on the musical instrument number data VOICE and the modified tone control parameters PITCH', LEVEL', ATTACK', and the like for the first sub-tone, in association with the control register group 22 and outputs the signal to the loudspeakers **25*a*, 25*b* through the distributing circuit 23 and the amplifiers 24*a*, 24*b*. Thereby, the first sub-tone corresponding to the operated switch of the pad switch group 14 is produced, with the same timing as the main tone, from the loudspeakers 25*a*, 25*b***.

After the completion of the "sub-tone producing processing program", the CPU 52 returns to the execution of the "pad switch program" (FIG. 9), adds "1" to the sub-tone number data SUBTON in step 309 to thereby change the data SUBTON to "2", and judges, in step 301, whether the changed value of the sub-tone number data SUBTON is larger than the value of the producing tone number data SIMUL. In this judgment, where the value of the sub-tone number data SUBTON is the same as that of the producing tone number data SIMUL or more, the judgment in step 310 indicates "YES" and the execution of the "pad switch program" is completed in step 312. Contrary, where the value of the sub-tone number data SUBTON is less than that of the producing tone number data SIMUL, the judgment in step 310 results in "NO" and the processing of steps 308–310 is executed again. In this case, because the sub-tone number data SUBTON is "2", the tone parameter for the main tone such as the pitch data PITCH, level data LEVEL, pan data PAN, and the like within the second area $53c_2$ of the buffer area **53*c* are modified in the "sub-tone producing processing program", based on the parameter modifying data for the second sub-tone such as the modifying pitch data ΔPITCH2, modifying level data ΔLEVEL2, modifying pan data ΔPAN2, and the like within the fourth area $53c_4$ of the tone producing buffer area 53*c*, to be outputted to the tone generator 20, and the second sub-tone modified in accordance with the modifying data ΔPITCH2, ΔLEVEL2, ΔPAN2, and the like produced, with the same timing as the main tone and the first sub-tone, from the loudspeakers 25*a*, 25*b***.

After the completion of the "sub-tone producing processing program", the CPU 52 returns to the execution of the "pad switch program" in step 309 and executes the cyclic processing composed of steps 308–310 until the value of the sub-tone number data SUBTON reaches that of the producing tone number data SIMUL. Thereby, the musical tones (main tones, the first sub-tones, the second sub-tones, etc.) equal in number to the value of the producing tone number data SIMUL are outputted from the loudspeakers **25*a*, 25*b* with the same timing as the operation of the pad switch group 14. As a result, according to the electronic musical instrument, plural musical tones corresponding to one kind of musical instrument tone in which each tone component such as the pitch, level, tone image position, attack time, etc. is somewhat different are simultaneously derived from plural loudspeakers 25*a*, 25*b***, with the result that an ensemble effect is achieved.

Now, description will be made on a case where the delay data DELAY set at step 303 has a value other than "0". In this case, "NO" is judged at step 307 in the "pad switch program" (FIG. 9), and the CPU 52 transfers, at step 311, the data stored in the tone generation buffer area **53*c* through the bus 30 for storage into the storage area (for example, storage area 56-3) of the delay tone producing memory 56 corresponding to the manipulated pad switch 14. In this case, out of the data stored in the tone producing buffer area 53*c*, all the data other than the assignment channel number data ASCH are transferred. After the processing at step 311, the CPU 52 proceeds to execution of the "main program" (FIG. 6) and continues executing cyclical processing consisting of steps 102 and 103** of the main program.

When the timer interrupt signal from the timer oscillator is input into the CPU 52 through the bus 30 in this condition, the CPU 52 starts, at step 400, execution of the "timer interrupt program" corresponding to the flow chart shown in FIG. 18. In this "timer interrupt program", the variable i is set at "0" at step 401, and all the data stored in the storage area 56-i of the delay tone producing memory 56 based on the variable i set at "0" are input at step 402 into the tone producing buffer area **53*c* whereafter the input data are judged to see whether or not they are the tone producing data at step 403**.

When musical tones are not to be produced, this judgment is performed by checking whether or not input data are present since all the data are cleared in the storage area 56-i of the delay tone producing memory 56 by the processing at step 414 to be described later. When no tone producing data are detected by the judgment processing at step 403, the CPU 52 continues executing the cyclical processings consisting of steps 402 through 405 until tone producing data are detected by executing the additional processing of the variable i at step 404 and the judgment processing of i>9 at step 405. When the variable i exceeds "9"during this cyclical processings, "YES" is judged based on i>9 at step 405, the execution of the "timer interrupt program" is terminated at step 406, and then the "main program" is executed once again.

On the other hand, "YES", i.e., "tone producing data presence" is judged at step 403, the CPU 52 controls production of sub-tones by executing a processing consisting of steps 407 through 414. At step 407, time data TIME input into the tone producing buffer area 53*c* by the processing at step 402 are updated by subtracting "1" from the value of the time data TIME, and whether or not the updated time data TIME is "0" is judged at step 408. When this judgment provides "NO", i.e., judges that the time data TIME has not reached "0" yet, all the data other than the assignment channel number data ASCH in the tone producing buffer area 53*c* are transferred for storage into the storage area 56-i of the delay tone producing memory at step 409. In addition, the variable i in this case has been initialized at step 401 or updated at step 404. When the "timer interrupt program" is terminated by the processings at steps 402 through 406 as described above after the processing at step 409, the "main program" is executed once again.

Each time a timer interrupt signal is input into the CPU 52 after lapse of time during the execution of the "main program", processing of the above-described "timer interrupt program" is executed. When the time data TIME is reduced one by one by the processing at step 407 and set at "0" by the processing at step 407, "YES" is judged at step 408 and the above-described "sub-tone processing program" (FIG. 11) is executed at step 410. By executing the "sub-tone processing program", the sub-tone (for example, the first or second sub-tone) based on the sub-tone control parameter stored in the storage area 56-i of the delay tone producing memory 56 is produced from the loudspeakers 25*a* and 25*b*. After the processing at step 410, the sub-tone number data SUBTON is updated by adding "1" to the data at step 411, and whether or not the updated sub-tone number data SUBTON is smaller than the producing tone number data SIMULA is judged at step 412.

When the sub-tone number data SUBTON is smaller than the producing tone number data SIMUL in this judgment processing, "YES" is judged, and the value of time data TIME is initialized as the delay data DELAY at step 413 by the processing similar to that at step 303, whereafter all the data including the initialized time data but other than the assignment channel number data ASCH in the tone producing buffer area 53*c* are transferred for storage into the storage area 56-i of the delay tone producing memory 56. This means a preparation for production of the next sub-tone, i.e., a preparation for production of the second sub-tone when the production of the first sub-tone is controlled in the "sub-tone producing processing program" at step 410 or a preparation for production of the third sub-tone when the production of the second sub-tone is controlled in the program.

Further, when the judgement processing at step 412 provides, "NO", i.e., judges that the sub-tone number data SUBTON is larger than the producing tone number data SIMUL, all the data are cleared in the storage area 56-i of the delay tone producing memory 56 at step 414. This means that all the sub-tones to be produced with a single manipulation of the pad switch have been produced.

When the "timer interrupt program" is terminated by the processings at steps 402 through 406 after the processings at steps 409 and 414, the "main program" is executed once again.

By the processings according to the "timer interrupt program" described above, the main tone, the first sub-tone, the second sub-tone, . . . are outputted from the loudspeakers 25*a* and 25*b* sequentially with time delays represented by the delay data DELAY, and as a result, a higher ensemble effect is realized in combination with the above-described effect producing slightly different musical tone elements such as pitch, level, tone image position, attack time, etc. when the delay data DELAY has a small value. When the delay data DELAY has a large value, the echo effect is also realized. Further, a effect to vary a tone image gradually throughout rising or decay of a musical tone is obtainable withe the electronic musical instrument by preliminarily setting different values of the attack data ATTACK or decay data DECAY among the musical tones such as the main tone, first sub-tone, second sub-tone, etc. as well as different values of pan data PAN.

Furthermore, when a tempo clock signal from the tempo oscillator 42 is input through the bus 30 into the CPU 52 during the cyclical processings at steps 102 and 103 of the "main program" (FIG. 6), the CPU 52 starts, at step 500, execution of the "tempo clock interrupt program" corresponding to the flow chart shown in FIG. 19, and judges whether or not the performance mode data PLYMD is "1" at step 501. In this case, since the play mode data PLYMD is set at "1" as described above, "YES" is judged at step 501 and production processing of the auto-rhythm tone is performed at step 502. The production processing of the auto-rhythm tone has no direct relation to the present invention and will not be described in detail. However, based on the data such as the rhythm type stored in the area 53*f* of the working memory 53 and the rhythm pattern data stored in the auto-rhythm pattern memory 57, the CPU 52 outputs data for controlling production of the rhythm tone to the tone producing circuit 20 to allow it to produce the rhythm tone signal by executing the assignment processing similar to that described above. After the processing at step 502, execution of the "tempo interrupt program" is terminated at step 503 and the "main program" is executed once again. Accordingly, it is possible to enjoy production of musical tones by manipulation of the pad switch group 14 in addition to the auto-rhythm performance. If the performance is stopped by manipulating the rhythm start/stop switch in the auto-rhythm switch group 18, the production of the rhythm tone signal is not controlled at step 502 and it is possible to enjoy production of musical tones solely by manipulation of the pad switch group 14.

Edit Mode

Now, description will be made on the edit mode for modifying the musical tone control parameters by manipulation of the ten key switch group 15, the edit switch group consisting of the enter switch 16a, clear switch 16b, UP switch 17a and DOWN switch 17b, and pad switch group 14. In this case, the performance mode data PLYMD is set at "0" by the "mode control program".

Figure 13:
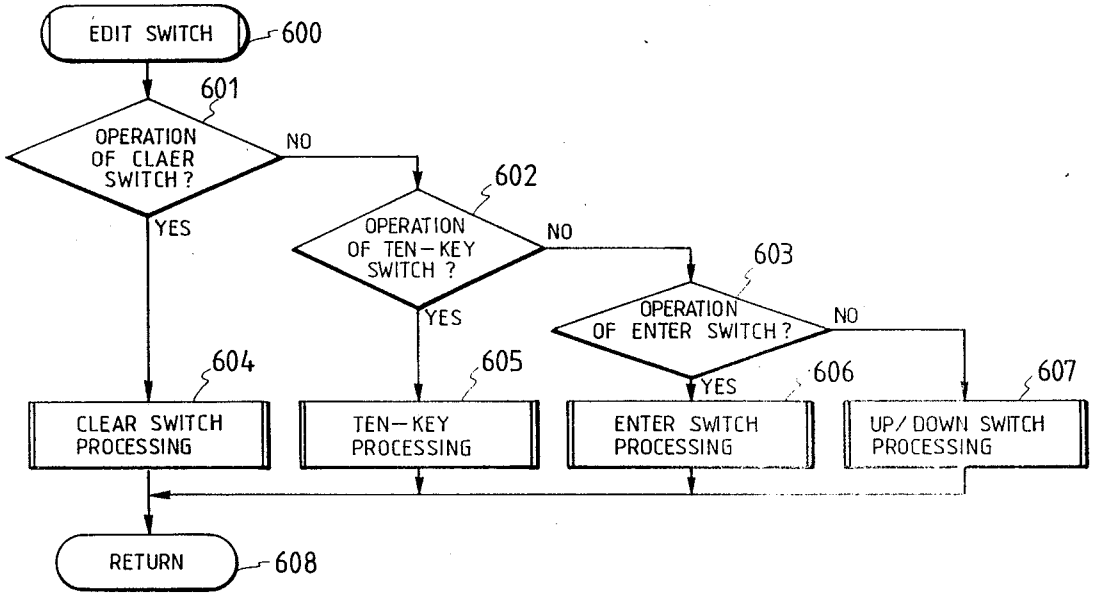

When any one switch in the edit switch group is manipulated, the CPU 52 starts, during the cyclical processing of the "main program", execution of the "edit switch program" corresponding to the flow chart shown in FIG. 13 at step 102 and, after the processings at steps 601 through 607, terminates the execution of the "edit switch program" at step 608, thereafter returning to the execution of the "main program" once again.

Operations to be performed by manipulating the clear switch 16b, ten key switch group 15, enter switch 16a, UP switch 17a and DOWN switch 17b will be described consecutively below.

Figure 14:
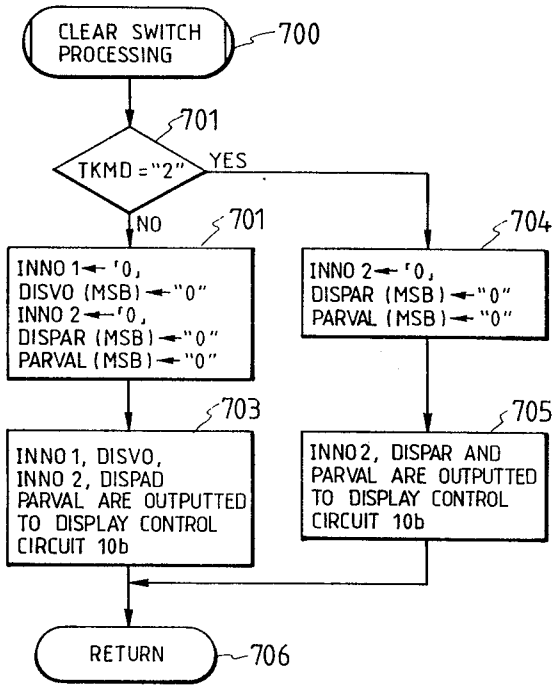

When the clear switch 16b is manipulated, "YES" is judged at step 601 of the "edit switch program", and the "clear switch processing program" corresponding to the flow chart shown in FIG. 14 is executed at step 604. In the "clear switch processing program", execution of the program is started at step 700, and whether or not value of the ten key mode data TKMD is "2" is judged at step 701. If, in this case, the ten key mode data TKMD is set at "0" or "1" in the "mode control program" (FIG. 8), i.e. if the ten-key switch group 15 is set in the first or second available mode designating a storage area No. in the parameter memory 54 or the memory 55 corresponding to the pad switch group, "NO" is judged at step 701, whereby the first and second input number data INNO1 and INN02 are set at "0", and the highest bit MSB of each of the musical instrument number date DISVO to be displayed, parameter number data DISPAR to be displayed and parameter value data PARVAL to be displayed is set at "0" at step 702. After the processing at step 702, the date INNO1, INN02, DISVO, DISPAR and DISVAL are output to the display control circuit 10b through the bus 30 at step 703, and the display control circuit 10b controls the display 11 on the basis of the supplied data, whereby the values of the first and second input number data INNO1 and INN02, i,e., zeroes, are displayed in the first and third display area 11a and 11c (FIG. 3B) of the display 11. However, since the highest bit MSB of each of the musical instrument number data DISVO to be displayed, parameter number data DISPAR to be displayed and parameter value data PARVAL to be displayed is set at "0", the musical instrument name, parameter name and parameter value are not displayed in the second, fourth and fifth display area 11b, 11d and 11e (FIG. 3B) of the display 11. As a result, when the data INNO1, INN02, DISVO, DISPAR and DISVAL are cleared, the cleared conditions are displayed on the display 11.

When the ten-key mode data TKMD is set at "2" in the "mode control program" (FIG. 8), i.e., when the ten-key switch group 15 is set in the third available mode designating a parameter No., "YES" is judged at step 701, and the second input number data INN02 as well as the highest bit MSB of each of the parameter number data DISPAR to be displayed and the parameter value data PARVAL to be displayed is set at "0" at step 704. After the processing at step 704, each of the date INN02, DISPAR and PARVAL is output to the display control circuit 10b through the bus 30 at step 705, and since the display control circuit 10b controls the display 11 on the basis of the supplied data, the value of the second input number data INN02, i.e., "0", is displayed in the third display area 11c of the display 11. Though the previous displayed conditions of the musical instrument No. and the musical instrument name are kept in the display area 11a and 11b of the display 11, the parameter name and the parameter value are not displayed in the display areas 11d and 11e since the highest bits MSB of the parameter number data DISPAR to be displayed and the parameter value data PARVAL to be displayed are set at "0". As a result, the data INNO1 and DISPAR as well as the displayed conditions thereof are kept in the previous conditions, and when the data DISVO, INN02 and parval are cleared, the cleared conditions are displayed on the display 11. After the processings at steps 704 and 705, the CPU 52 terminates the execution of the "clear switch processing program" at step 706 and returns to the execution of the "main program" (FIG. 6) through the execution of the "edit switch program" (FIG. 13).

Figure 15:
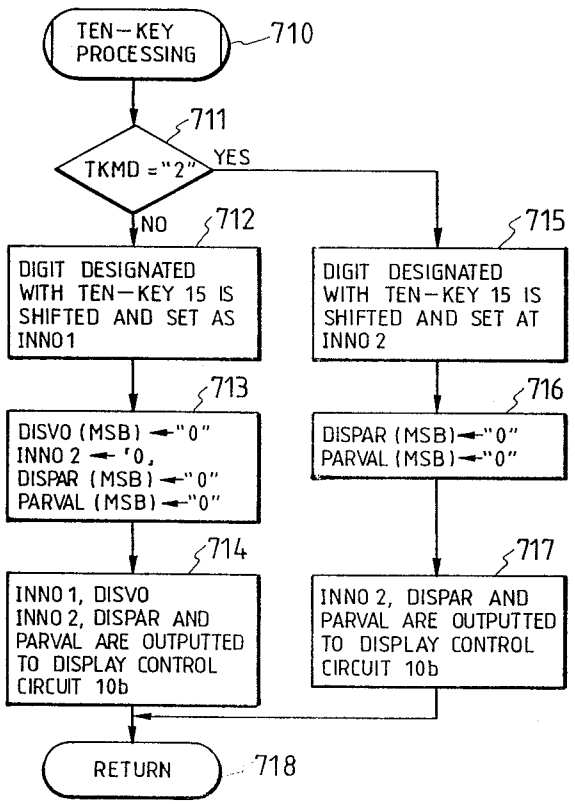

Now, description will be made on the operations to be performed by manipulating any one switch in the ten-key switch group 15. When any one switch in the ten-key switch group 15 is manipulated, "NO" and "YES" are judged at steps 601 and 602 respectively of the "edit switch program" (FIG. 13), and the "ten-key processing program" corresponding to the flow chart shown in FIG. 15 is executed at step 605. In the "ten-key processing program", execution of the program is started at step 710 and whether or not value of the ten key mode data TKMD is "2" is judged at step 711 in the procedure similar to that at step 701. If, in this case, the ten-key mode data TKMD is set at "0" or "1", "NO" is judged at step 711 and the number corresponding to the manipulated switch in the ten-key switch group 15 is shifted (carried) as the first input number data INNO1 at step 712. Then, at step 713, the second input number data INN02 is set at "0", and the highest bit MSB of each of the musical instrument number data DISVO to be displayed, parameter number data DISPAR to be displayed and parameter value data PARVAL to be displayed is set at "0". After the processing at step 713, the data INNO1, INN02, DISCO, DISPAR and PARVAL are outputted to the display control circuit 10b through the bus 30, and the display control circuit 10b controls the display 11 on the basis of the supplied data, whereby the first input number data INNO1 input by manipulating the ten key switch 15 is displayed in the first display area 11a (FIG. 3B) of the display 11 and the value of the second input number data INN02, i.e., "0", is displayed in the third display area 11c (FIG. 3B). However, since the highest bit MSB of each of the musical instrument number data DISVO to be displayed, parameter number data DISPAR to be displayed and parameter value data PARVAL to be displayed is set at "0", the musical instrument name, parameter name and parameter value are not displayed in the second, fourth and fifth display areas 11b, 11d and 11e (FIG. 3B) of the display 11. As a result, the first input number data INNO1 is displayed on the display 11 when the data is input, and cleared conditions of the data INN02, DISVO, DISPAR and PARVAL are displayed on the display 11 when the data are cleared.

If the ten-key mode data TKMD is set at "2" in the mode control program" (FIG. 8), "YES" is judged at step 711, and the number corresponding to the key switch manipulated in the ten-key switch group 15 at step 715 is shifted (carried) as the second input number data INN02 at step 715. Then, the highest bit MSB of each of the parameter number data DISPAR to be displayed and parameter value data PARVAL to be displayed is set at "0" at step 716. After the processing at step 716, the data INN02, DISPAR and PARVAL are outputted to the display control circuit 10*b* through the bus 30, and the display control circuit 10*b* controls the display 11 on the basis of the supplied data, whereby the second input number data INN02 input by manipulating the ten key switch 15 is displayed in the third display area 11*c* (FIG. 3B) of the display 11. However, since the highest bits MSB of the parameter number data DISPAR to be displayed and parameter value data PARVAL to be displayed are set at "0" respectively, the parameter name and parameter value are not displayed in the fourth display area 11*d* and fifth display area 11*e* (FIG. 3B) of the display 11. In this case, the number corresponding to the previously set first input number data INNO1 and the musical instrument name corresponding to the previously set musical instrument number data DISVO are displayed in the first display area 11*a* and the second display area 11*b* of the display 11 in the unchanged conditions. As a result, the second input number data INN02 is displayed on the display 11 when the data is input, and cleared conditions of DISPAR and PARVAL are displayed when the data is cleared. After the processings at steps 714 and 717, the CPU 52 terminates the execution of the "ten key processing program" at step 718 and returns to the execution of the "main program" (FIG. 6) through the execution of the "edit switch program" (FIG. 13).

Figure 16:
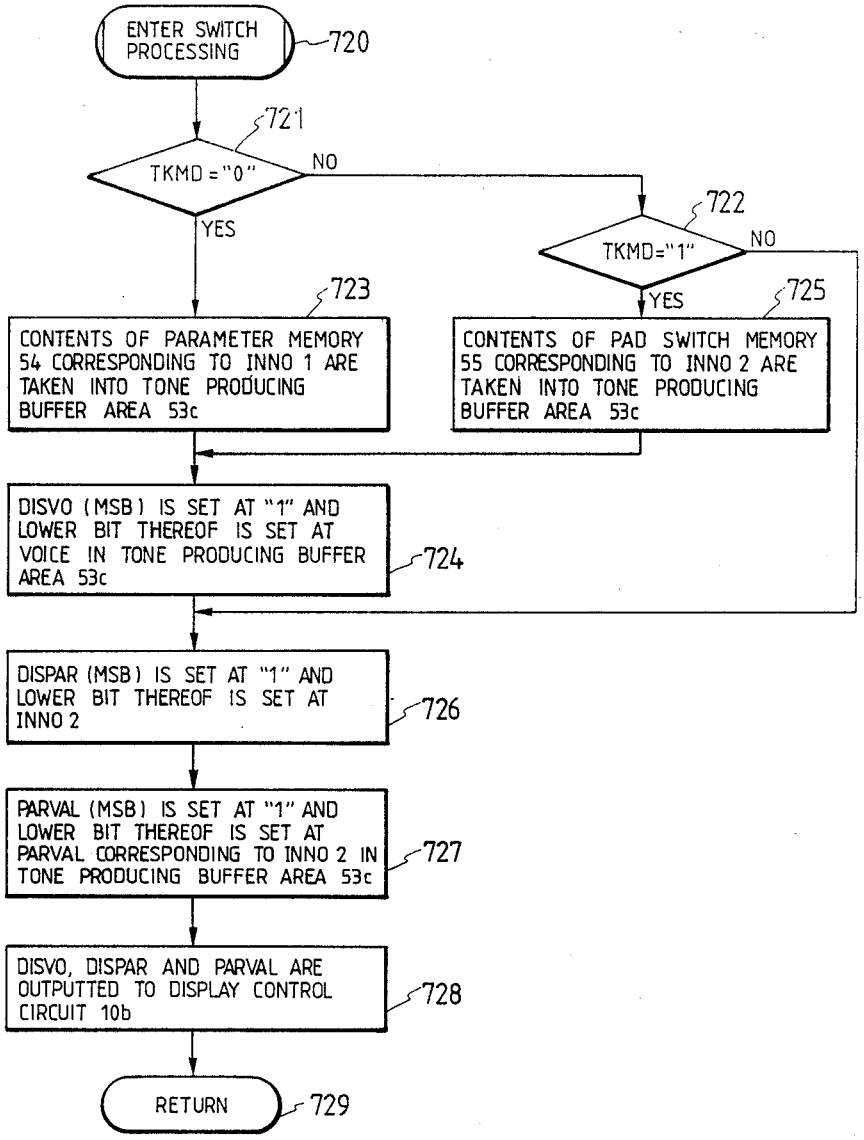

When the enter switch 16*a* is manipulated in this condition, "NO", "NO" and "YES" are judged at steps 601, 602 and 603 respectively of the edit switch program" (FIG. 13), and the "enter switch processing program" corresponding to the flow chart shown in FIG. 16 is executed at step 606. In this "enter switch processing program", execution of the program is started at step 702, and whether the ten-key mode data TKMD is "0", "1" or "2" is judged at steps 721 and 722. If the ten-key switch group 15 is set in the first available mode for designating the storage areas 54-0, 54-1, . . . , 54-99 of the parameter memory 54, "YES" is judged to confirm that the ten key mode data TKMD is "0" at step 721, and all the data in the storage area (for example, storage area 54-13) of the parameter memory 54 corresponding to the value of the first input number data INNO1 (the number displayed in the display area 11*a*) are taken into the tone producing buffer area 53*c*. Then, the highest bit MSB of the musical instrument number data DISVO to be displayed is set at "1" and the lower bits of the data area set at the musical instrument number data VOICE taken into the tone producing buffer area 53*c*, whereafter the program proceeds to step 726. If the ten-key switch group 15 is set in the second available mode for designating the storage areas 55-0, 55-1, . . . , 55-9 of the memory 55 corresponding to the pad switch, "NO" and "YES" are judged at steps 721 and 722 respectively to confirm that the ten-key mode data TKMD is "1", and all the data in the storage area (for example, storage area 54-3) of the memory 55 corresponding to the pad switch corresponding to the first input number data INNO1 (the number displayed in the display area 11*a*) are taken into the tone producing buffer area 53*c* at step 725. Then, similarly to the operations described above, the highest bit MSB of the musical instrument number data DISVO to be displayed is set at "1" and the lower bit of the data is set at the musical instrument number data VOICE taken into the tone producing buffer area 53*c* at step 724, whereafter the program proceeds to step 726. By the processings at steps 723 and 725, the musical tone control parameter regarding the musical tone to be modified is taken into the tone producing buffer area 53*c*.

On the other hand, if the ten-key switch group 15 is set in the third available mode for designating the parameter number in the tone producing buffer area 53*c*, "NO" and "NO" are judged at steps 721 and 722 respectively to proceed the program directly to step 726.

At step 726, the highest bit MSB of the parameter number data DISPAR to be displayed is set at "1" and the lower bit of the data is set at the second input number data INN02 set for designating the musical tone control parameter. Then, the highest bit MSB of the parameter value data PARVAL to be displayed is set at "1" and the lower bits of the data are set at the parameter value data PARVAL corresponding to the second input number data INN02 (displayed in the display area 11*c* in the tone producing buffer memory 53*c* at step 727, and the musical instrument number data DISVO to be displayed, parameter number data DISPAR to be displayed and parameter value data PARVAL to be displayed which are set by the processings at steps 724, 726 and 727 are outputted to the display control circuit 10*b* through the bus 30. Since the highest bit MSB of each of the data DISVO, DISPAR and PARVAL is set at "1" in this case, the musical instrument name, parameter name and parameter value corresponding to the data DISVO, DISPAR and PARVAL are displayed in the second, fourth and fifth display areas 11*b*, 11*d* and 11*e* of the display 11. After the processing at step 728, the CPU 52 terminates the execution of the "enter switch processing program" (FIG. 13) at step 729 and returns to the execution of the "main program" (FIG. 6) through the execution of the "edit switch program" (FIG. 13).

By the execution of the "enter switch processing program" described above, the first input number data INNO1 or the second input number data INN02 inputted with the ten key switch group 15 in each ten key switch mode is determined, the musical tone control parameter to be edited is taken into the tone producing buffer area 53*c*, and the contents of the musical tone control parameter to be edited are displayed on the display 11.

When the performer manipulates any one switch in the pad switch group 14 in this condition, the CPU 52 starts, during the cyclical processing of the "main program", execution of the "pad swith program" corresponding to the flow chart shown in FIG. 9 at step 300 and judges whether or not the play mode data PLYMD is "1" at step 301. Since the electronic musical instrument is set in the edit mode and the performance mode data PLYMD is set at "0" in this case, "NO" is judged at step 301 and the musical tone control parameter in the tone producing buffer area 53*c* is stored into a storage area (for example, storage area 55-3) of the memory 55 corresponding to the manipulated pad switch 14 at step 313. Accordingly, the musical tone control parameter in an optional storage area of 54-0 54-1, . . . , 54-99 of the parameter memory 54 or an optional storage area of 55-0, 55-1, . . . , 55-99 of the memory corresponding to the pad switch is assigned and stored into the storage area corresponding to the manipulated pad switch 14.

After the processing at step 313, the above-described processings at steps 303 and later are executed, and the main tone and sub-tone based on the control parameter stored in the tone producing buffer area 53c are produced from the loudspeakers 25a and 25b. If the timer interrupt signal from the timer oscillator 41 is input into the CPU 52 in this condition, the "timer interrupt program" (FIG. 18) is executed and the delayed sub-tone is also produced, but the auto-rhythm tone is not produced since "NO" is judged at step 501 to confirm that the play mode data PLYMD is "0" and the processing at step 502 for producing the rhythm tone is not executed even though the tempo clock signal from the tempo oscillator 42 is inputted into the CPU 52 and "tempo clock interrupt program" is executed. By the production of the main tone and sub-tone described above, the player can confirm the musical tone assigned to the pad switch 14.

Figure 17:
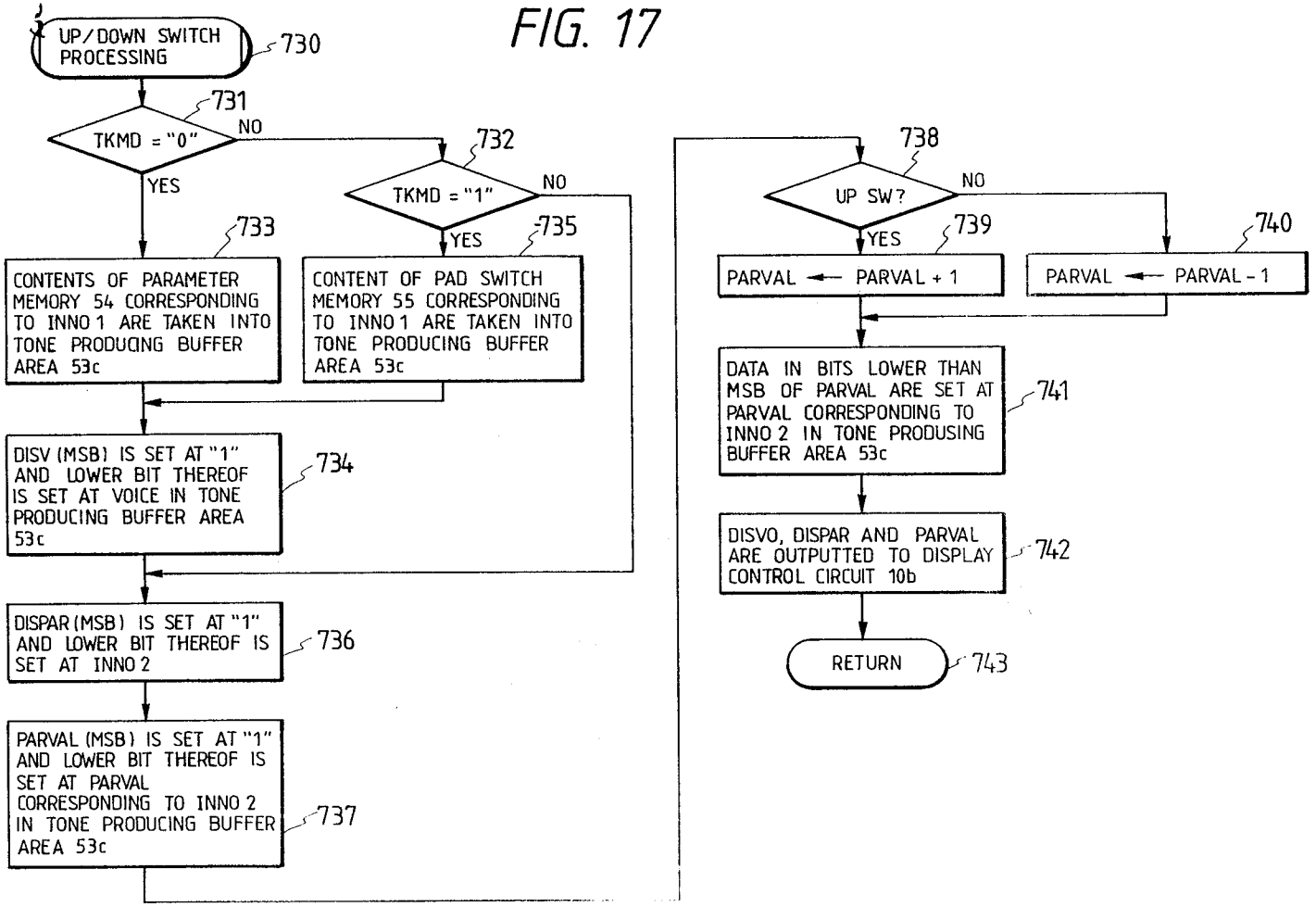

Now, description will be made on modification of the musical tone control parameter. For this purpose, the player manipulates the UP switch 17a or the DOWN switch 17b manipulation of the enter switch 16a or without manipulating the switch. By this manipulation, "NO", "NO" and "NO" are judged at steps 601, 602 and 603 respectively of the "edit switch program" (FIG. 13), and the "UP/DOWN switch processing program" corresponding to the flow chart shown in FIG. 17 is executed at step 607. In the "UP/DOWN switch processing program", execution of the program is started at step 703, and the processings at steps 731 through 737 similar to those at steps 721 through 727 of the "enter switch processing program" are executed, whereby the first input number data INNO1 or the second input number data INN02 inputted with the ten-key switch group 15 in each ten-key mode is determined and the musical tone control parameter to be edited is taken into the tone producing buffer area 53c. These processings at steps 731 through 737 are unnecessary when the UP switch 17a or the DOWN switch 17b is manipulated after manipulation of the enter switch 16a, but necessary for taking the musical tone control parameter to be edited into the tone producing buffer area 53c when the UP switch 17a or the DOWN switch 17b is manipulated without manipulating the enter switch 16a.

After the processing at step 737, whether the manipulated switch is the UP switch 17a or the DOWN switch 17b is judged at step 738. When the manipulated switch is the UP switch 17a, "YES" is judged at step 738 and the parameter value data PARVAL (displayed on the display 11) of the parameter designated with the ten key switch group 15 as described above is updated by the addition processing "PARVAL +1" at step 738. If the manipulated switch is the DOWN switch 17b, "NO" is judged at step 738 and the parameter value data PARVAL is updated by the subtraction processing "PARVAL—1" at step 740. After the processing at step 739 or 740, the data other than the highest bit MSB of the parameter value data PARVAL are updated and stored as the musical tone control parameters corresponding to the value of the second input number data INN02 in the tone producing buffer area 53c at step 741. Accordingly, the musical instrument number data VOICE as the control parameter designated by any switch in the ten-key switch group 15, available channel number data POLY, producing tone number data SIMUL, delay data DELAY, pitch data PITCH, level data LEVEL, pan data PAN, attack data ATTACK, decay data DECAY, modification pitch data ΔPITCH1, ΔPITCH2 and ΔPITCH3, correction level data ΔLEVEL1, ΔLEVEL2, and ΔLEVEL3, correction pan data ΔPAN1, ΔPAN2, ΔPAN3, etc. are modified optionally in accordance with manipulation of the UP switch 17a or the DOWN switch 17b.

After the processing at step 741, the musical instrument number data DISVO to be displayed, parameter number data DISPAR to be displayed and parameter value data PARVAL to be displayed are outputted to the display control circuit 10b through the bus 30 at step 742 by the processing similar to that at step 728, and the set musical instrument name, parameter name and updated parameter value corresponding to the data DISVO, DISPAR and PARVAL are displayed on the display 11. After the processing at step 742, the CPU 52 terminates the execution of the "UP/DOWN switch processing program" at step 743 and returns to the execution of the "main program" (FIG. 6) through the execution of the "edit switch program".

When the player manipulates any switch in the pad switch group 14 in this condition, the "pad switch program is executed, whereby the musical tone control parameter in an optional storage area of 54-0, 54-1, . . . , 54-99 of the parameter memory 54 or an optional area of 55-0, 55-1, . . . , 55-9 of the memory corresponding to the pad switch is assigned and stored into the storage area of the memory 55 corresponding to the manipulated pad switch 14, and the main tone and sub-tone based on the modified control parameter are outputted from the loudspeakers 25a and 25b for confirmation of the tones to be assigned.

As is understood from the description of the functions, this embodiment permits optionally setting various musical tone control parameters by execution of the "edit switch program" in accordance with manipulations of the edit switch group on the operation panel 10 on the edit mode and optionally assigning a musical tone to each switch in the pad switch group 14 by execution of the "pad switch program" in accordance with manipulations of the pad switch group 14. In each play mode, musical tones corresponding to the pad switches 14 and set musical tone control parameters are produced by executing the "pad switch program" set by manipulating the pad switch group 14. Accordingly, the electronic musical instrument according to the present invention enhances flexibility for performance to permit enjoying musical tones produced within a broader range. Further, this embodiment permits setting optional numbers of musical tones to be produced by manipulating a single pad switch and makes it possible to play the musical instrument in a mode which is not available conventionally.

Modification examples

Modification examples of the above-described embodiment will be described below.

(1) Though the pad switch group 14 is adopted as the manipulators to be manipulated by the player and the musical tones are produced from a percussion instrument in accordance with manipulations of the pad switch group 14 in the embodiment described above, it is possible to apply the present invention also to an electronic musical instrument such as a piano or flute producing musical tones other than those of a percussion instrument. In such a case, it is preferable to use a keyboard equipped with a plural number of keys in place of the pad switch group 14 so that musical tones having the pitches corresponding to the keys are produced, and number of tones to be produced by a single manipulation of a key is controlled for each key or each key range, for example, an octave. Further, in case of an electronic musical instrument having a plural number of keyboards, for example, an upper keyboard, a lower keyboard and a pedal keyboard, it is preferable to control the number of musical tones to be produced with a single key manipulation on each keyboard.

(2) In the embodiment described above, the number of musical tones produced by a single manipulation of a switch in the pad switch group 14 is controlled by the producing tone number data SIMUL used as the musical tone control parameter and the data SIMUL is modified in accordance with manipulation of the edit switch group. However, it is possible to arrange a plural number of generating tone number setting switches, corresponding to the pad switches 14, on the control panel 10 and directly control producing tone numbers with the switches. Further, it is possible to directly control the musical tone control parameters with a plural number of switches arranged separately on the operation panel 10.

(3) In the embodiment described above, the producing tone number data SIMUL is modifiable with each switch in the pad switch group 14 for each musical tone to be generated. However, it is possible to divide the pad switches 14 into a plural number of groups and modify the producing tone number data SIMUL for musical tones corresponding to the pad switches 14 in each group. In this case also, it is possible, as in the case of (2) described above, to directly control number of musical tones to be produced without using the producing tone number data SIMUL but with a single manipulation of one of plural switches 14 arranged separately in plural groups on the control panel 10.

(4) Though musical tones are outputted from two loudspeakers 25*a* and 25*b* in the embodiment described above, it is possible to use more loudspeakers to produce musical tones. In this case, it is advantageous to prepare the pan data PAN for each musical tone in the number of sets equal to the number of loudspeakers and control volumes of musical tones to be produced from each loudspeaker in accordance with each pan data PAN. Such a design will make it possible to produce musical tones with stereo effect higher than that available in the embodiment described above.

(5) In the embodiment described above, a single set of delay data DELAY is prepared for each musical tone so as to reserve a definite delay time between the main tone and the first sub-tone, between the first sub-tone and the second sub-tone, etc. respectively. However, it is possible to reserve a delay time between the main tone and the fist sub-tone which is different from the delay time between the first sub-tone and the second sub-tone, etc. In this case, it is preferable to prepare the delay data DELAY in plural sets and design each set of delay data DELAY so as to be modifiable and controllable independently.

(6) In the embodiment described above, the delay time between the main tone and the first sub-tone and that between the first sub-tone and the second sub-tone, etc. can be determined independently of the tempo of the auto-rhythm. However, it is possible to synchronize the delay time with the tempo of the auto-rhythm. In this case, it is preferable to adopt such a design as to execute the "timer interrupt program" shown in FIG. 9 upon arrival to the CPU 52 of the tempo clock signal from the tempo oscillator 42 or use, as the timer interrupt signal, a signal having a frequency proportional to and higher than the frequency of the tempo clock signal.

(7) In the embodiment described above, the parameter value data PARVAL is increased one by one upon each manipulation of the UP switch 17*a* and decreased one by one upon each manipulation of the DOWN switch 17*b*. However, it is possible to select such a design as to increase or decrease the parameter value data PARVAL one by one upon a single manipulation of the UP switch 17*a* or the DOWN switch 17*b* and, when the switch 17*a* or 17*b* is manipulated continuously, increase or decrease the data PARVAL successively at predetermined time intervals during the continuous manipulation. Further, it is possible to adopt such a design as to modify setting of the parameter value data PARVAL by using the ten key switch group 15. Though the musical tone control parameters in the storage areas 54-0, 54-1 through 54-99 of the parameter memory 54, the storage areas 55-0, 55-1 through 55-9 of the memory corresponding to the pad switches and the tone producing buffer area 53*c* are designated by manipulating the ten key switch group 15 in the embodiment described above, it is possible to designate the parameters by using the UP switch 17*a* and the DOWN switch 17*b*.

What is claimed is:

1. In an electronic musical instrument provided with plural manipulators indicating the generation of musical tones and musical tone generating means composed of plural musical tones and musical tone generating channels generating individual musical tones in accordance with the operation of said plural manipulators, the improvement comprising:

means for selectively designating a number of tones for each of said plural manipulators, said number of tones designated for each manipulator being generated by the operation of a corresponding manipulator; and assignment control means for assigning each of said plural manipulators to said musical tone generating channels equal in number to said number of tones designated by said means for designating and controlling the generation of musical tones relative to each operated manipulator in said assigned musical tone generating channels.

2. An electronic musical instrument according to claim 1, wherein said means for designating the number of tones comprises:

musical tone number data storing means for storing musical tone number data representative of the number of tones generated by the operation of manipulators, said musical tone number data corresponding to individual manipulators; and data changing means for changing the musical tone number data stored in said musical tone number data storing means.

3. An electronic musical instrument according to claim 1, wherein said assignment control means comprises:

assignment channel determining means for determining the musical tone generating channels to be assigned to a manipulator, a number of said tone generating channels to be assigned to a manipulator being equal to the number of tones designated by said means for designating for a respective manipulator in accordance with a predetermined assignment condition; and data feeding means for feeding data relative to each operated manipulator to the musical tone generating channels determined by said assignment channel determining means.

4. An electronic musical instrument according to claim 1, wherein said assignment control means comprises:

assignment channel determining means for determining the musical tone generating channels to be assigned to an operated manipulator, a number of said tone generating channels to be assigned to a manipulator being equal to the number of tones designated by said means for designating for a respective manipulator in accordance with a predetermined assignment condition;

parameter storing means for storing musical tone control parameters controlling a generation mode of each musical tone corresponding to each of said plural manipulators; and parameter feeding means for feeding said musical tone control parameters relative to each operated manipulator to the musical tone generating channels determined by said assignment channel determining means.

5. In an electronic musical instrument provided with plural manipulators assigning the generation of musical tones and musical tone generating means composed of plural musical tone generating channels generating individual musical tones in accordance with the operation of said plural manipulators, the improvement comprising:

means for selectively designating a number of tones for each of said plural manipulators, said number of tones being generated by the operation of a corresponding manipulator;

parameter storing means for storing musical tone control parameters controlling a generation mode of each musical tone corresponding to each of said plural manipulators;

assignment control means for assigning each of said plural manipulators to musical tone generating channels equal in number to the number of tones designated by said means for designating for a corresponding manipulator and supplying said musical tone control parameters corresponding to each operated manipulator to the assigned musical tone generating channels to control the generation of musical tones; and parameter changing means for changing plural musical tone control parameters stored in said parameter storing means.

6. An electronic musical instrument according to claim 5, wherein said means for designating comprises:

musical tone number data storing means for storing musical tone number data representative of the number of tones generated by the operation of manipulators, said musical tone number data corresponding to individual manipulators; and data changing means for changing the musical tone number data stored in said musical tone number data storing means.

7. An electronic musical instrument according to claim 5, wherein said assignment control means comprises:

assignment channel determining means for determining the musical tone generating channels to be assigned to a manipulator, a number of said tone generating channels to be assigned to a manipulator being equal to the number of tones designated by said means for designating for a respective manipulator in accordance with a predetermined assignment condition; and parameter feeding means for feeding the musical tone parameters corresponding to each operated manipulator, stored in said parameter storing means, to said musical tone generating channels determined by said assignment channel determining means.

8. An electronic musical instrument according to claim 5, wherein the musical tone control parameters stored in said parameter storing means are data controlling pitches of tones to be generated.

9. An electronic musical instrument according to claim 5, wherein the musical tone control parameters stored in said parameter storing means are data controlling tone colors of tones to be generated.

10. An electronic musical instrument according to claim 5, wherein the musical tone control parameters stored in said parameter storing means are data controlling loudnesses of tones to be generated.

11. An electronic musical instrument according to claim 5, wherein the musical tone control parameters stored in said parameter storing means are data controlling modulations of tones to be generated.

12. An electronic musical instrument according to claim 5, wherein the musical tone control parameters stored in said parameter storing means are data controlling time intervals of plural tones to be generated in accordance with the operation of said manipulators.

13. An electronic musical instrument, comprising:

plural manipulators, each of which is operable to designate tone generation;

means for freely designating a number of tones to be assigned to a manipulator;

means for generating musical tones, said musical tone generating means comprising plural tone generation channels assignable to said plural manipulators, wherein each tone generation channel generates an individual tone; and means for assigning tone generation channels equal in number to said number of tones designated by said tone number designating means to a corresponding manipulator;

wherein said tone generation channels assigned to a manipulator generate said number of tones designated by said tone number designating means in response to operation of said corresponding manipulator.

14. An electronic musical instrument according to claim 13 wherein said plural manipulators are separated into groups and said tone number designating means includes means for freely designating a number of tones for each manipulator group and further wherein when any one of the manipulators in any manipulator group is operated, a number of tones equal to a number of tones designated for the corresponding manipulator group is generated.

15. An electronic musical instrument according to claim 13, further comprising:

parameter storing means for storing musical tone control parameters controlling a generation mode of each musical tone corresponding to each of said plural manipulators;

parameter changing means for changing plural musical tone control parameters stored in said parameter storing means.

16. An electronic musical instrument, comprising:

at least one manipulator operable to designate tone generation;

means for freely designating a main tone and at least one sub-tone to be assigned to a manipulator;

means for generating musical tones, said musical tone generating means comprising plural tone generation channels assignable to a manipulator, wherein each tone generation channel generates an individual tone; and means for assigning tone generation channels to a corresponding manipulator, one tone generation channel to be assigned for said main tone and additional tone generating channels to be assigned for any sub-tones designated by said tone designating means;

wherein when a manipulator is operated, said tone generation channels assigned to said operated manipulator generate said main tone and any sub-tones assigned to said operated manipulator.

* * * * *

UNITED STATES PATENT AND TRADEMARK OFFICE

CERTIFICATE OF CORRECTION

PATENT NO. : 4,957,552

DATED : September 18, 1990

INVENTOR(S) : Hiroyuki Iwase

It is certified that error appears in the above-identified patent and that said Letters Patent is hereby corrected as shown below:

On the title page, before "[21]", insert --[73] Assignee: Yamaha Corporation, Hamamatsu, Japan

Signed and Sealed this

Seventeenth Day of March, 1992

*Attest:*

HARRY F. MANBECK, JR.

*Attesting Officer*

*Commissioner of Patents and Trademarks*